US009462917B2

(12) United States Patent
Licari

(10) Patent No.: US 9,462,917 B2
(45) Date of Patent: Oct. 11, 2016

(54) SUSPENDED FLUID DISPENSER SYSTEM AND APPARATUS

(76) Inventor: Yaffa Sheina Licari, New York City, NY (US)

( * ) Notice: Subject to any disclaimer, the term of this patent is extended or adjusted under 35 U.S.C. 154(b) by 0 days.

(21) Appl. No.: 11/393,196

(22) Filed: Mar. 29, 2006

(65) Prior Publication Data

US 2007/0012727 A1 Jan. 18, 2007

Related U.S. Application Data

(60) Provisional application No. 60/670,459, filed on Apr. 11, 2005.

(51) Int. Cl.

| | |
|---|---|
| ***B67D 3/00*** | (2006.01) |
| ***A47K 5/12*** | (2006.01) |
| ***A47K 5/13*** | (2006.01) |

(52) U.S. Cl.

CPC . *A47K 5/12* (2013.01); *A47K 5/13* (2013.01); *A47K 2005/1218* (2013.01)

(58) Field of Classification Search

CPC ... A47K 5/12; A47K 5/13; A47K 2005/1218
USPC ..... 222/167, 192, 181.1, 160, 181.2, 206, 222/164, 181.3, 166; 248/311.3, 222.12, 248/224.7, 311.2, 213.2, 202.1; 220/478, 220/481, 483; 215/399
See application file for complete search history.

(56) References Cited

U.S. PATENT DOCUMENTS 682,680 A * 9/1901 Fribourg ..... 222/181.2
809,896 A * 1/1906 Bender ..... 222/517
1,072,940 A 9/1913 Goppelt
1,285,362 A * 11/1918 Philbin ..... 222/166
2,196,356 A * 4/1940 De Sipio et al. ..... 222/162
2,317,729 A * 4/1943 Bruno ..... 285/377
2,319,233 A * 5/1943 Hoppe ..... 222/181.2

(Continued)

FOREIGN PATENT DOCUMENTS

FR 1510902 12/1967
WO WO 00/41608 7/2000

OTHER PUBLICATIONS

International Search Report, PCT/US06/13628, Sep 26, 2006.

(Continued)

*Primary Examiner* — Kevin P Shaver
*Assistant Examiner* — Robert Nichols, II
(74) *Attorney, Agent, or Firm* — Zaretsky Group PC; Howard Zaretsky

(57) ABSTRACT

A novel and useful mountable and rotatable fluid dispenser comprises a container or fluid reservoir and a coupler. The container is adapted to be suspended from, and rotationally coupled to, a mounting point selected by a consumer. The container has at least one outlet at a first position on an outer surface thereof. The coupler is located at a second position on the outer surface and attachable by a consumer to the selected mounting point. The coupler is adapted to be re-attachable as desired by the consumer. The fluid dispenser further comprises a position stabilization mechanism for maintaining the user-determined position of the container when not being acted upon, whereby a consumer controls the dispensing of fluid from the container by re-orienting the height of the outlet between any non-dispensing position and any dispensing position without decoupling the container from the mounting point.

41 Claims, 31 Drawing Sheets

(56) References Cited

U.S. PATENT DOCUMENTS

| | | | | | |
|---|---|---|---|---|---|
| 2,513,029 | A | * | 6/1950 | Lapointe | 248/311.3 |
| 2,751,117 | A | * | 6/1956 | Packwood, Jr. | 222/80 |
| 2,968,995 | A | * | 1/1961 | Holden | 248/467 |
| 2,981,442 | A | | 4/1961 | Anderson | |
| 3,178,059 | A | * | 4/1965 | Packwood, Jr. | 222/45 |
| 3,198,437 | A | * | 8/1965 | Faglie | 239/309 |
| 3,217,939 | A | * | 11/1965 | Murray | 222/167 |
| 3,813,072 | A | | 5/1974 | Moore | |
| 4,131,232 | A | * | 12/1978 | Pollinzi | 239/314 |
| 5,022,625 | A | * | 6/1991 | Klinkhardt | 248/309.2 |
| 5,067,680 | A | * | 11/1991 | Miller | 248/311.3 |
| 5,125,577 | A | | 6/1992 | Frankel | |
| 5,251,777 | A | * | 10/1993 | McMahon | 220/480 |
| 5,709,319 | A | * | 1/1998 | Yao | 222/170 |
| 5,749,490 | A | * | 5/1998 | Keicher | 220/481 |
| 5,857,594 | A | | 1/1999 | Ozturk | |
| 6,086,031 | A | * | 7/2000 | Renfro | A01M 31/02 182/187 |
| 6,390,427 | B1 | * | 5/2002 | McConnell et al. | 248/231.61 |
| 6,672,480 | B1 | * | 1/2004 | Miller | 222/129 |
| 6,695,174 | B2 | * | 2/2004 | Sørensen et al. | 222/214 |
| 6,808,090 | B2 | * | 10/2004 | Pedersen | 222/181.3 |
| 7,275,729 | B2 | * | 10/2007 | Sherman | A47G 25/08 224/148.7 |
| 7,475,859 | B2 | * | 1/2009 | Selders | A45B 3/06 211/107 |
| 2003/0160066 | A1 | * | 8/2003 | Houvras | 222/181.3 |

OTHER PUBLICATIONS

Supplementary European Search Report, EP06749863, Apr. 29, 2009.

* cited by examiner

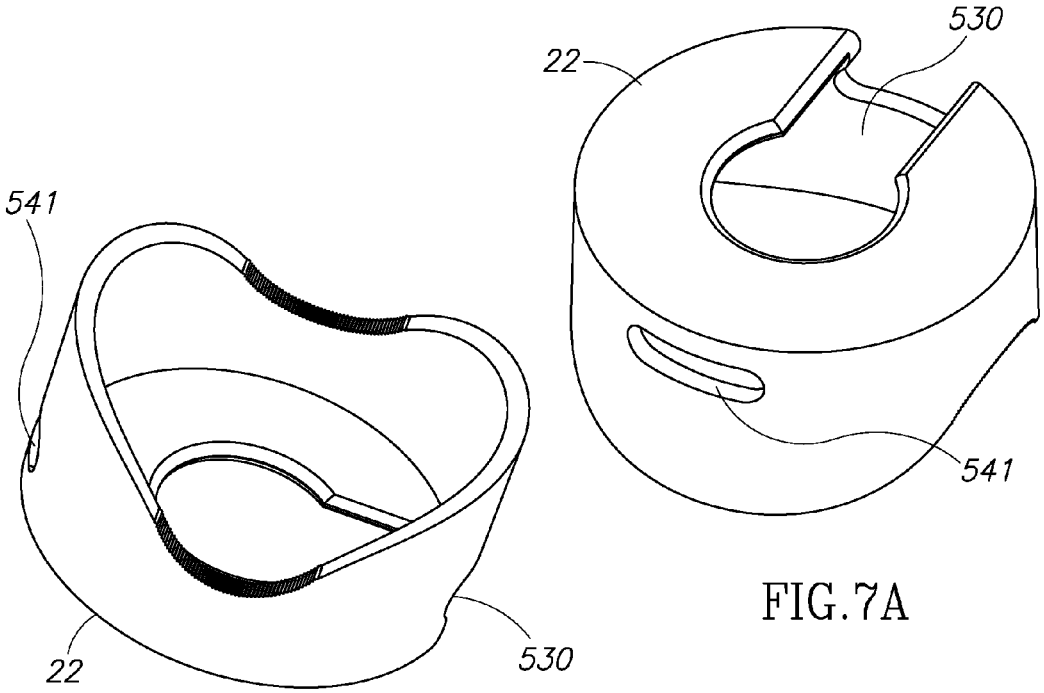
FIG.7A
FIG.7B
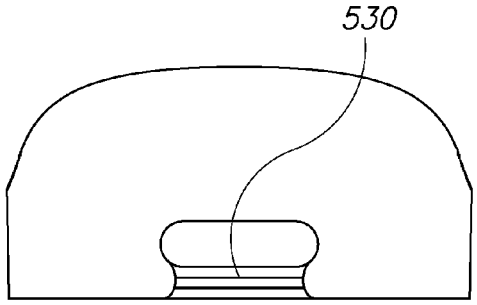
FIG.7C
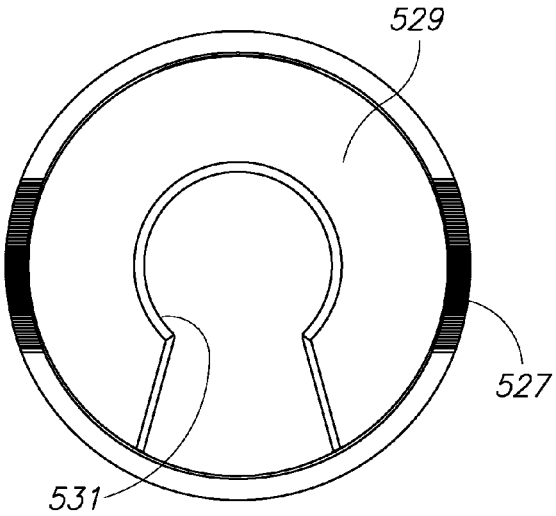
FIG.7D

SUSPENDED FLUID DISPENSER SYSTEM AND APPARATUS

REFERENCE TO PRIORITY APPLICATION

The present application claims priority from U.S. Provisional Application Ser. No. 60/670,459, filed Apr. 11, 2005, entitled "Kitchen and Bath Dispenser System and Apparatus".

FIELD OF THE INVENTION

The present invention relates generally to a system and apparatus for dispensing flowable products. More particularly, the present invention relates to consumer-suspended, fluid product dispensing containers for dispensing consumer quantities of fluids ranging from liquid to granular solid powder.

BACKGROUND OF THE INVENTION

Many consumer products such as dishwashing detergent, hand soap, shampoo, hair conditioner, toothpaste, condiments including mustard, ketchup, mayonnaise, syrup, honey and viscous food fluids such as jams, jellies, peanut butter, and the like, are packaged in containers that are often recloseable and have a capacity anywhere from an individual portion to 64 fluid ounces or more. The containers are typically made from molded materials (PE, PETE, PP, ABS, polycarbonate, etc.) and generally have a structure which includes a lower end adapted to maintain them in a standing position on a flat surface and an upper end having an outlet for dispensing the fluid. Covers for outlets range in complexity from simple twist-off caps, and lift-up nozzles to compressible pumps and squeezable bottles having integrated pre-measured dose cups. Additionally, some containers are specially shaped for a specific purpose, such as sculpted or narrowed near the middle to improve grip.

The known methods and structures for dispensing such consumer-directed fluid products commonly rely on a combination of picking up the dispenser container, opening its outlet, positioning it over the dispensing area (food, sponge, hand, etc.), and either inverting and pouring, or by applying pressure directly or via some pump mechanism to the contents in the container to get the fluid through the outlet onto the intended target. One might dispense product into one's cupped hand either at the work area or at a distance from where it will be used (assuming one has two hands available) and then bringing the dispensed product to its intended destination, for example, in or over a countertop, table surface, sink or tub. The operation differs little if the container is equipped with a pump. In any case, most known dispensing containers must be opened, positioned, manipulated and restored to their former position and condition, or by applying pressure to a pump.

Many instances of dispensing operations require two free hands for any combination or permutation of the following operations to be performed either sequentially or contemporaneously: to manipulate an outlet to a dispensing position, to hold the dispenser in place while a pump is actuated, to invert rotate or otherwise change the resting position of the entire container in order to move viscous fluids to the dispensing outlet, to restore the container to a non-dispensing position or state. Frequently, fluids are dispensed directly into a user's hand, while the other hand is occupied with manipulating the container.

With respect to cost, providing a dispensing fluid container with a pump- or siphon-action fluid outlet is relatively significantly more expensive than providing a fluid container with a gravity-dependent fluid outlet. Moreover, a pump can suffer from mechanical failure and be inefficient in that most are unable to extract some significant portion of fluid from a nearly-emptied container, especially if the fluid is very viscous.

When viscous fluids such as gels, jams, hair conditioner, mayonnaise, honey, mustard, glues and the like are sold or kept in pouring-type dispensers having a flat bottom resting area and a recloseable dispensing fluid outlet at or near the opposing top end, the time it takes to perform each successive dispensing operation increases as the distance between the surface level of the fluid and the outlet increases. Furthermore, product waste is practically inevitable as the contents are gradually used since some product often clings to the bottom lower sides of the container interior. Related to this, between dispensing operations, gravity causes viscous fluid to accumulate at the lowest point of the fluid container, i.e. usually the end farthest away from the dispensing opening. In an effort to reduce time to pour and to reduce waste, strategies must be employed to keep the bulk of the remaining viscous fluid accumulating closer to the dispensing opening. For example, toothpaste tubes and bottles, shampoos, conditioners, body washes, ointments and a wide variety of flowable personal hygiene, cosmetics and cleaning products are supplied in dispensing bottles or tubes with flat covers over the dispensing openings so they may be stored standing on their head, so to speak, between uses. Unfortunately, that requires that the tube be rested on a flat surface, usually a kitchen, sink or bath countertop, tabletop or ledge, thus adding to clutter, increasing potential for spills and residual drips, soiling and using some of the most valuable and heavily used real estate in any home or work environment. Some containers are made squeezable to allow consumers to squeeze the product up and out, but as anyone who has ever squeezed a tube of toothpaste knows, the squeezing operation can become a chore. In the alternative, product is wasted by those not desirous of employing economizing strategies.

Work surface areas, including tabletops and countertops in most environments, domestic or commercial, are often at a premium. For example, counter-top space in the vicinity of water outlets, e.g., sink faucets, bath and shower outlets, in even the largest household kitchens and bathrooms is usually precious and domestic engineers agree that reduction of kitchen and bathroom counter clutter, and increasing counter availability, is important for achieving and maintaining efficiency and tranquility. The same is true for many culinary, commercial and industrial settings.

In situations where a fluid dispenser will get heavy use, such as in a public restroom or dining hall, the risk of passing infection increases where other people must handle the container at its dispensing point and along its outer side surfaces of the dispenser sufficiently firmly to maintain a grip and invert the dispenser. A dispenser that requires less contact to dispense its contents is more hygienic.

References show mechanisms for hanging fluid dispensers in inverted positions from housings which are fixed to the wall. These are typically fitted with push-up valves. Unfortunately, such devices often have flow-rate control and leakage issues, resulting almost inevitably in spillage on the counter or articles below the dispenser. Additionally, users will often soil the area around a sink by dripping product or water onto the counter in the process of moving their hands from the spout end of the faucet to the dispenser and back to a position over the sink.

With reference to food service establishments, many provide condiments such as ketchup, barbecue sauce, salad dressing, and the like from pump-equipped containers. Frequently the containers can't be pumped dry as they can't get the last bit at the bottom. Furthermore, pumps are often difficult to control and users often spill condiment on the countertop instead of on the food, adding to maintenance.

U.S. Pat. No. 5,857,594 discloses a device which comprises a soap dispenser that is attached to the end of a faucet and further comprises a valve mechanism. Unfortunately, most sinks have only one or two faucet ends, substantially limiting the potential locations and space-saving potential for the device. Additionally, placing anything at the end of the faucet affects the usage of both faucet and sink, as well as increasing the likelihood of accidental discharge of soap into water used for food preparation.

Similarly, PCT Publication No. WO 00/41608, of International Application PCT/AU00/00015, discloses a device for positioning solid soap in the water stream by suspending the device from the end of the water-dispensing faucet.

The combination liquid soap dispenser and protective cover for water fixtures disclosed in U.S. Pat. No. 5,125,577 similarly positions a device having a soap container directly in contact with a faucet end, therefore negatively affecting normal sink usage, access to which should be as unimpeded as possible at all times.

SUMMARY OF THE INVENTION

The present invention is a novel and useful mountable and rotatable suspended fluid dispenser. Exemplary embodiments of fluid dispensers for end users useful in the system of the present invention [a] make use of often-underutilized space; [b] conserve product; [c] conserve work environment space and normalcy of operation while still permitting easy use of the fixture; [d] permit pre-positioning of the dispenser directly over its intended use environment, such as the sink/tub drain, so that should normal and excess product dispensing or spillage occur, clean-up effort and time are reduced; [e] may be easily adapted to suit attachment to a wide variety of fixtures; [f] dispense viscous fluids easily, quickly and with greater efficiency, without interfering with the normal operation of the fixture where attached and its environment; and [g] permit truly one-handed operation so simple that even a toddler can use it, among other advantages.

The fluid dispenser apparatus of the present invention also provides exceptional advertising value, by improving conspicuity of the container brand, being in daily view whether or not in use, and even adding visible surface area for advertising/marketing.

Embodiments of the present invention provide a solution for storing and dispensing powders and viscous fluid products used by consumers in closest proximity to their area of actual use, with minimal impact on the normal use of the space, thereby reducing time, clutter, spillage, clean up, and reducing the risk of non-food chemicals accidentally dripping onto the sink, tub, food-preparation area, table surface or even food itself.

Furthermore, embodiments of the present invention overcome the difficulty of finding an attachment system which is able to engage a large number of the great variety of fixtures with respect to being able to adapt to their sometimes complex and varied cross-sectional conformation, size and space restrictions presented by the area in consideration.

Moreover, exemplary embodiments of the present invention permit the marketing and use of fluid containers that are disposable/replaceable. Additionally, the fluid containers of some exemplary embodiments, by being relieved of the constraints of requiring a flat resting surface substantially opposite the dispensing end, allow for a vast new variety of design options with distinctive and attractive shapes and other physical characteristics as well as production methods which are not now possible in the case of known containers constructed to stand independently upright on a counter top.

These and other advantages and characteristics are achieved by providing a coupler that is attached or attachable to a fluid dispensing container and is also attachable to the external surface of a fixture. Either the fluid container is rotatable with respect to the coupler, the coupler is rotatable relative to the fixture, or both. By rotatable, it is meant that the height of the outlet of the fluid dispensing container relative to the level of the fluid within can be changed in small user-determined incremental movements, in at least one plane that has a vertical component. Attachment between the coupler and fluid dispensing container can be accomplished in any of a number of different ways. As an example, a coupler may be able to be incrementally rotated by hand around the longitudinal axis of fixtures having a wide range of shapes and sizes, of the kind that can be attached or found adjacent to and/or overhanging a work surface, such as a countertop or tabletop, sink fixture such as a faucet or an adjacent sprayhead, suspended rod, tension rod, column, or countertop dishwashing machine vent, as examples.

A rotating coupler can comprise a mechanism as mechanically simple as an elastic arranged in a harness-type arrangement on a fluid container, which is attached to a fixture, preferably suspended above or protruding out over the desired zone of use, in such a way and in such a position as to allow orientation of the fluid level with respect to the outlet as desired. Preferably, the fluid container can be rotated in a controllable, incremental manner in at least one plane having a vertical component such that the rotation elevates or lowers the fluid outlet with respect to the level of the fluid contained therein. By controllable manner, it is meant that a user can selectively and deliberately choose the vertical position the fluid dispensing outlet relative to the surface of the fluid in the container. By simply rotating the coupler or the container, or both, a user can easily control liquid flow-rate and fluid level in the container relative to the fluid outlet, i.e. such that, between dispensing operations, the fluid accumulates in the area of or directly adjacent to the fluid outlet or accumulates well away from the dispensing opening to prevent accidental discharge, or anywhere in between. This is especially advantageous when dispensing viscous fluids or controllably dispensing fluid, even with one hand unavailable.

Furthermore, a user should preferably be able to choose the position of the rotating coupler along substantially the entire length of an elongated horizontal and vertical fixture and be accommodative of a broad range of widths, and cross-sectional conformations with which fixtures such as those commonly found in kitchens and bathrooms are found. Other exemplary embodiments may be suitable for attachment at an edge or on a vertical or horizontal surface.

Exemplary embodiments of the present invention facilitate one-handed operation by even the youngest user with little or no training, and eliminate the need for picking up a potentially large, but slippery surfaced bottle.

Exemplary embodiments of the invention include those comprising a fluid container or reservoir and a coupler adapted for rotatably coupling the fluid reservoir container to an exterior surface, an edge, or a fixture having at least some longitudinal aspect such as a closet rod, a column, a sink faucet, bath fixture, towel bar, or sprayhead.

Additional exemplary embodiments of the invention include those comprising a dispensing container and coupler for coupling the dispensing container to an exterior surface of a sink faucet or bath fixture, wherein the coupler comprises an axle for rotation in a plane having some vertical component of the dispensing container relative to the sink faucet or bath fixture.

Yet other exemplary embodiments of the invention comprise a dispensing container and coupler for coupling the dispensing container to a suspended rod, a vertical shaft or column, an edge or an exterior surface, wherein the exterior surface might be that of a sink faucet, bath fixture, or a neck affixed to a surface at or adjacent to a target site, intended environment of use.

And still other exemplary embodiments of the invention comprise a dispensing container and coupler for coupling the dispensing container to an exterior surface of a fixture, wherein the dispensing container holds and dispenses a fluid, which may be a liquid, particulate, gel, foam, paste, or any other flowing material normally dispensed from a bottle.

Another exemplary embodiment of the invention comprises a dispensing container and coupler for coupling the dispensing container to an exterior surface of a neck, sink faucet shaft, vegetable spray head base or bath fixture, wherein the coupler is rotatable in a plane around the faucet, i.e. perpendicular to the longitudinal axis of the neck.

Another exemplary embodiment of the invention comprises a dispensing container and coupler for coupling the rotatable dispensing container to or around an exterior surface fixture having a longitudinal portion, wherein the direction of rotation of the dispensing container is in a plane having a vertical component and preferably parallel to the longitudinal portion of the faucet.

A further exemplary embodiment of the invention comprises a dispensing container and coupler for coupling the dispensing container to or around an exterior surface of a fixture, wherein the coupler is selected from the group comprising a clamp, a cuff, a bracelet, an elastic band, a strap, or hook and loop strap.

Still a further exemplary embodiment of the invention comprises a dispensing container and coupler for coupling the dispensing container to an exterior surface of a sink faucet or bath fixture, wherein the coupler comprises an adapter, the adapter comprises a cooperative lockable mechanism further comprising cooperative locking components attached to or integrally formed on the container and the adapter.

In yet a further exemplary embodiment of the present invention, the container and adapter are each provided with one of a pair of interlocking members.

In still a further exemplary embodiment, one interlocking member has a male configuration and the other has an interlocking female configuration. The male interlocking member and female configuration interlocking member have complementary shapes and sizes designed to permit manual incremental rotation of one relative to the other, thereby translating rotational motion to the dispensing container relative to the fixture. The male interlocking member may be attached to or integrally formed on the dispensing container and the female interlocking member.

An exemplary embodiment of a dispensing container and coupler according to the present invention has a coupler that comprises a faucet adapter, attached to the faucet adapter is at least one male protuberance, and the container has a female receptacle; the male protuberance and female receptacle are complementarily shaped and sized relative to one another to permit the male protuberance to be securely, yet removeably, received and retained into female receptacle.

In many exemplary embodiments, the dispensing container or containers can be rotated relative to the coupler.

Many of the exemplary embodiments include a dispensing container which is capped with a recloseable cap. Exemplary embodiments of the dispenser container of the present invention could have collapsible flexible walls. Some exemplary embodiments of the dispenser container may have all rigid walls.

Other exemplary embodiments will have at least one shape-maintaining wall and at least one collapsible wall.

A dispensing container of the present invention could have at least one surface adaptation for being securely attached to a sink fixture with an elastic coupler. The dispensing container can have grooves formed at or near each end for securely receiving an elastic coupler for attachment to a sink fixture.

One exemplary embodiment of a dispensing container has at least one groove formed on an outer surface thereof, the groove having a shape and being positioned to cooperate with the outer surface of a fixture to stabilize the position of the dispensing container against the fixture outer surface.

An exemplary embodiment of a coupler for rotatably attaching at least one fluid dispensing container to an external surface of a sink fixture has surfaces to provide resistance to rotational force to increase the force required to move the dispensing container and thereby reduce accidental dislocation of the dispensing container from a desired position relative to the sink or bath fixture.

The coupler could comprise a hook and loop (Velcro®) strap, a spring-loaded band, a notched rubber strap or a cradle.

In yet another exemplary embodiment, the fixture adapter portion of the coupler could have one or more surfaces contoured to reduce unintentional movement with respect to the fixture.

As an example, the dispensing container can have guide grooves which can help the container be seated against the faucet in various positions.

The exemplary embodiments of fluid containers of the present invention could dispense at least one fluid selected from the group consisting of liquid toiletry, dishwashing detergent, flowable cosmetics, soaps, shampoos, hair conditioner, body wash, skin creams, moisturizers, soap bubbles, bath salts and crystals, bubble bath, shaving cream/lotion, toothpaste, hair gels, hair mousse, pastes, adhesives, sealants, caulks and anything flowable that is used near/in conjunction with a kitchen, dining room, kitchen sink, bathroom/washroom sink, bathing facility, workshop or classroom.

Additional exemplary embodiments of fluid containers taught by the present invention could quickly and cleanly dispense viscous fluid comestibles, such as ketchup, mustard, honey, maple syrup, chocolate topping and other condiments.

Even powder fluids, such as laundry detergent powder, sugar, salt, spices, could easily be dispensed from containers constructed in accordance with the present invention.

BRIEF DESCRIPTION OF THE DRAWINGS

FIG. 7A is a front perspective view of an exemplary embodiment of a coupler constructed in accordance with teachings of the disclosure taken from below;

FIG. 7B is a rear perspective view of the exemplary embodiment of the coupler in FIG. 7A, taken from above the left side;

FIG. 7C is a top plan view of the exemplary embodiment of the coupler in FIG. 7A;

FIG. 7D is a rear elevation view of the exemplary embodiment of the coupler in FIG. 7A;

DETAILED DESCRIPTION OF THE INVENTION

Figure 1:
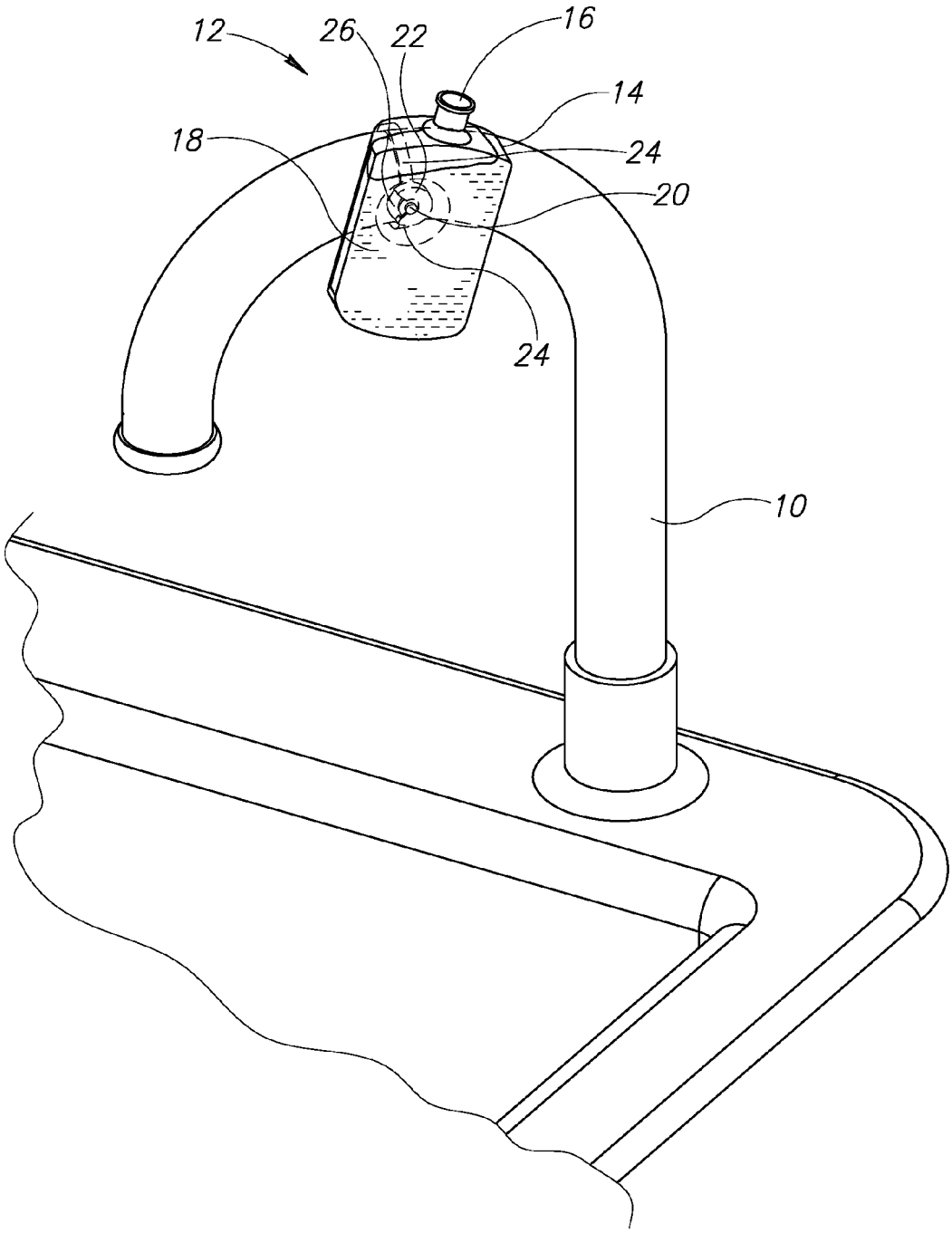
FIGS. 1-3 are perspective views of a translucent, mostly-filled dispensing device constructed in accordance with an exemplary embodiment of the teachings of the disclosure and in pre-dispensing, dispensing and post-dispensing positions, respectively.

The present invention comprises a novel apparatus for fluid dispensers targeted at consumers or end users, and a novel system and method of merchandising that is enabled by the novel apparatus. The apparatus comprises mechanisms and methods for allowing a consumer to suspend one or more fluid dispensers in a strategic location in the vicinity of where the fluid will actually be used. The suspension mechanism is simple to manufacture and use yet highly adaptable to accommodate the range of potential fixtures from which consumers may wish to suspend the dispensers. Furthermore, the exemplary embodiments comprise an apparatus for adapting a fluid reservoir or container, often provided in advance with an outlet, to be attached to a fixture via a coupler. The structural relationship between either the coupler and fixture, or the coupler and coupled fluid container, is such that a user can manually, controllably and incrementally rotate the fluid container such that its outlet travels in a path having a vertical component. The outlet is thereby movable by each user between a storage position, i.e. where the fluid surface is below or at the bottom of the outlet, and a dispensing position, where the fluid surface level is above the bottom of the outlet, and vice versa.

Preferably, the more the user is able to control the position of the outlet via rotation, the better. Thus, there is a corresponding need for the coupling to be securely attached to the fixture; enough to resist the torque applied by a user in repositioning the outlet. The invention balances the needs between the mechanisms that facilitate rotation and position maintenance of the container relative to the coupler and of the coupler relative to the fixture. A satisfactory balance yields a container and coupler which in use are stable relative to the fixture and yet sufficiently sensitive to permit fine, and even infinite, degrees of adjustment of the container relative to the fixture by a user repositioning the dispenser between a dispensing and nondispensing storage position, usually by rotation.

In typical use, it is contemplated that after dispensing, the user relocates the outlet, stopping rotation with the top surface of the remaining fluid just below the outlet, sufficiently to prevent dripping, yet closely enough so that when the next user has to dispense the fluid, the fluid will already be accumulated in the area immediately adjacent to or just below the outlet, by the force of gravity alone, and readily available for dispensing. Subsequent dispensing operations thus require less time and relatively little effort to get the fluid level to rise above the outlet level and pour out. Typically, a few degrees of rotation is sufficient to achieve pouring out of the fluid. A simple and minimal upward twist of the container stops the fluid from dripping and readies the dispenser for the next user.

The containers of the exemplary embodiments described hereinbelow are preferably made from molded or cast materials commonly used in packaging fluids for resale. Useful materials include thermoplastics such as polycarbonate, polypropylene, polyethylene, vinyl, PETE, etc. as well as traditional materials such as glass, ceramic and light metals. While the invention is scalable over a wide range and containers can have a fluid storage capacity of from fractions of a fluid ounce to several gallons, most consumer applications will only require fluid storage containers having a capacity of ¼ fluid ounce to about 128 ounces. Variable factors such as size, weight, shape, volume, materials, etc. are somewhat interdependent and the degree of variation is well within the skill of the ordinary person skilled in the art of product packaging design. The combination of the factors described above and two relevant resultant torsional values (i.e. the force to twist the container and the attachment force of the coupler to resist twisting around the fixture), will help determine how the artisan designs the overall apparatus, given the anticipated uses and target environment of the particular product. For instance, gently squeezing the flexible sides of a container aids a user in the dispensing operation. If the container is expected to be fairly heavy, then the thickness of the walls are of some importance with respect to preventing undesired shape distortion. A floppy container may be undesirable or aesthetically displeasing.

The system is particularly well-suited for dispensing particulate fluids and viscous fluids, such as liquid soap, toothpaste, detergents, syrups, honey, condiments, cleaning powders, laundry powders, gels, sealants, adhesives, pastes and the like.

Exemplary embodiments of the present invention further comprise a product and system adapted for attachment to a variety of fixtures. Examples of fixtures with which the fluid dispensers are adapted to be used include: kitchen and bath plumbing fixtures including faucets, spigots, taps, spray heads, shelving and cabinetry; as well as work surfaces, countertop, tabletop and wash basin rim surfaces via couplers that are specifically designed for receiving the fluid containers of the present invention, and permitting the manual rotation thereof, while resisting dislocation of the coupler after installation and during and between dispensing operations.

Considering the numerous shapes and sizes the attachment site fixture can have, in order to give the consumer the greatest degree of freedom, the invention provides attachment mechanisms that are easily and suitably (i.e. tightly attached or rotatable under appropriate manual force) adaptable to fit many, if not most, of the fixtures most closely associated with and proximate to the environment where the fluid would be likely dispensed. Generally the categories of fixtures include (1) those that have some longitudinal dimension and cross-section around which a coupler can be attached, (2) those with angled edges and (3) those presenting flat surfaces. For example, fixtures (found in and around washing installations, e.g., a kitchen sink, a laundry room sink, a washroom sink, a bathtub, etc. as well as surrounding or adjacent work surfaces such as countertops, islands, tabletops) including faucets, spray nozzle housings, and spigots can be roughly cylindrical, rectangular, elliptical, etc. Nearly all, however, have some portion that is somewhat elongated, though their sizes, terminal conformations and cross-sections can vary greatly. Therefore products like toothpastes, soaps, conditioners, toiletries, etc. would be suitably packaged and marketed in containers adapted for coupling to plumbing fixtures or countertops. Exemplary embodiments of the present invention are thus generally adaptable for use with one or more of fixtures having some longitudinal conformation, an edge such as that of a shelf or window sill, or a flat surface, i.e. planar or non-planar.

In the following description of exemplary embodiments, like parts in different embodiments are designated by like reference numerals increased in increments of hundreds.

With reference to FIG. 1, an exemplary embodiment of fluid dispenser 12 is rotatably coupled via coupler 22 (shown and described hereinbelow) to fixture 10, which in this instance comprises a sink faucet spout. Fluid dispenser 12 comprises a container 14 having an outlet 16. Container 14, shown here as translucent for clarity of discussion, is made from any material or materials normally used for such purposes, e.g., light molded materials such as thermoplastics like PET, PVC, polycarbonate, polypropylene, polyethylene, glass, ceramic, etc. Additionally, flexible pouches, for example of the disposable type, may be adapted for use in the invention as long as provision, for example an exoskeletal frame, is made for providing some rigidity to at least one wall of the pouch, preferably the wall to which a pivot button or female housing is or would be attached or formed. The outlet for a pouch or puncturable container can be created by the consumer using any suitable means such as a pin, nail, scissors, tear-off, etc.

Figure 5A:
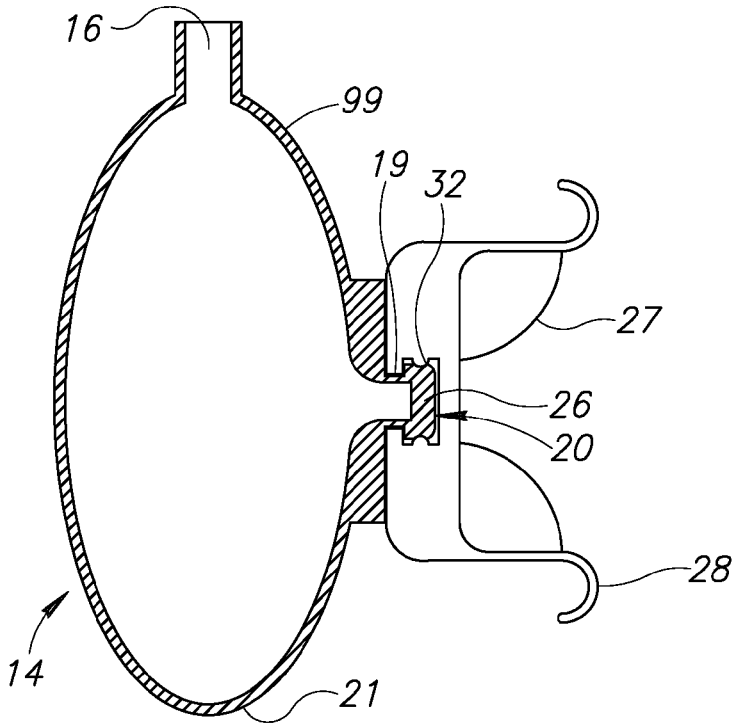
FIG. 5A is a partial cross-section view of a container's attachment to a coupler to form a fluid dispenser having a rotational axis in accordance with teachings of the disclosure.
Figure 5B:
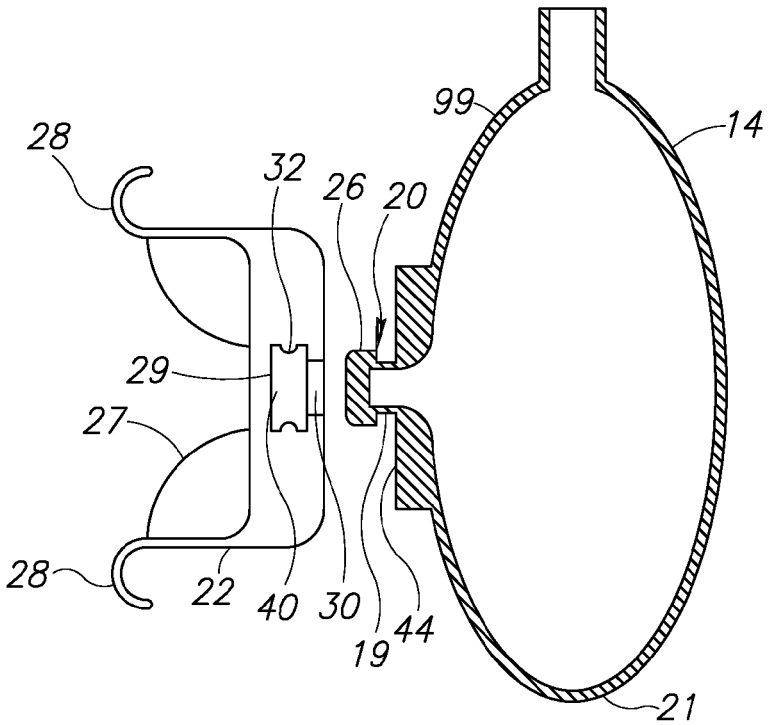
FIG. 5B is an exploded partial cross-section view of the container and coupler shown in FIG. 5A.
Figure 5C:
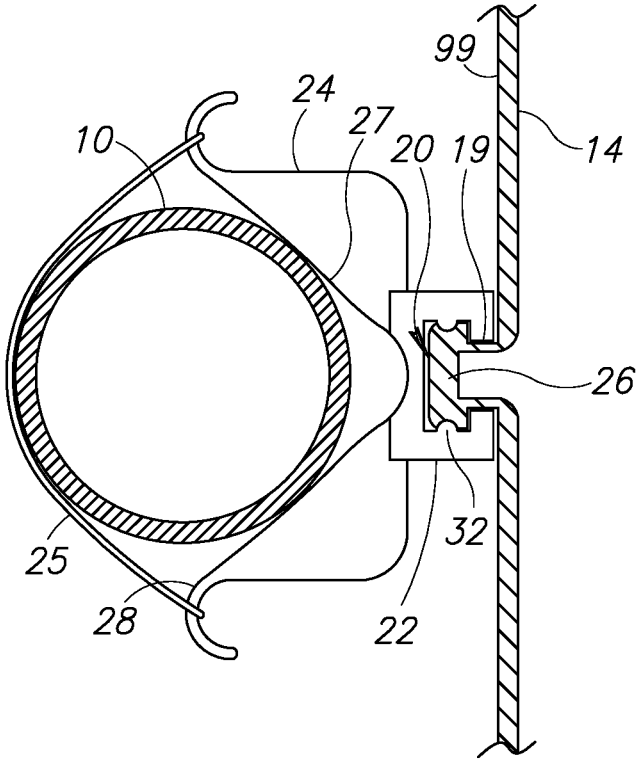
FIG. 5C is a partial detailed cross-section view showing attachment of a container-coupler combination, i.e. fluid dispenser, using a strap of the kind shown in FIGS. 4A-4E, to a fixture in accordance with teachings of the disclosure.

The present invention provides bottle designers with new degrees of freedom in designing a fluid container which can be shaped without regard to adaptations, e.g., a flattened area, legs and dimples, for maintaining it in a standing position when placed on a surface. Thus container 14 is shown in FIGS. 5A-5C as having a substantially elliptical periphery in profile, everywhere but the outlet 16, with little or no regard to their ability to stand on a horizontal surface.

Figure 5D:
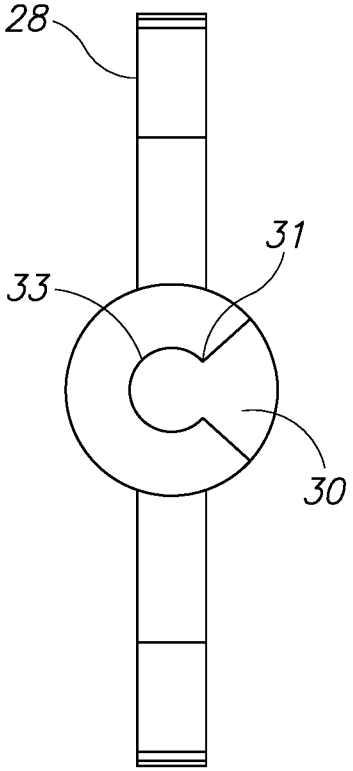
FIG. 5D is a front elevation view of an exemplary female embodiment of a coupler constructed in accordance with teachings of the disclosure and shown in FIGS. 5A, 5B and 5C.

Referring again to FIGS. 1-3, translucent container 14 contains translucent fluid 18 and has an outlet 16 on its periphery. Outlet 16 will often have an outlet cover 17 (FIG. 9), such as a twist off or threaded on cap, a lift-up hinged flap lid, pop/pull up extending nozzle, and the like. Due to the unique character of the fluid dispenser 12, outlet cover 17 can be replaceable, recloseable, disposable or not present at all. Due to the stable nature of the containers of the present invention, many products may be packaged and marketed in fluid containers that do not have caps at all, for example where the outlet is purchased sealed and is subsequently unsealed, punctured or cut open by the consumer. Coupler 22, visible through fluid 18 in FIGS. 2 and 3, has a receiving chamber 29 (FIG. 5B) which is provided on an outer surface with pivot slot 30 (FIG. 5D) shaped somewhat like an inverted skeleton-key hole for receiving the pivot button 20 of container 14.

Figure 2:
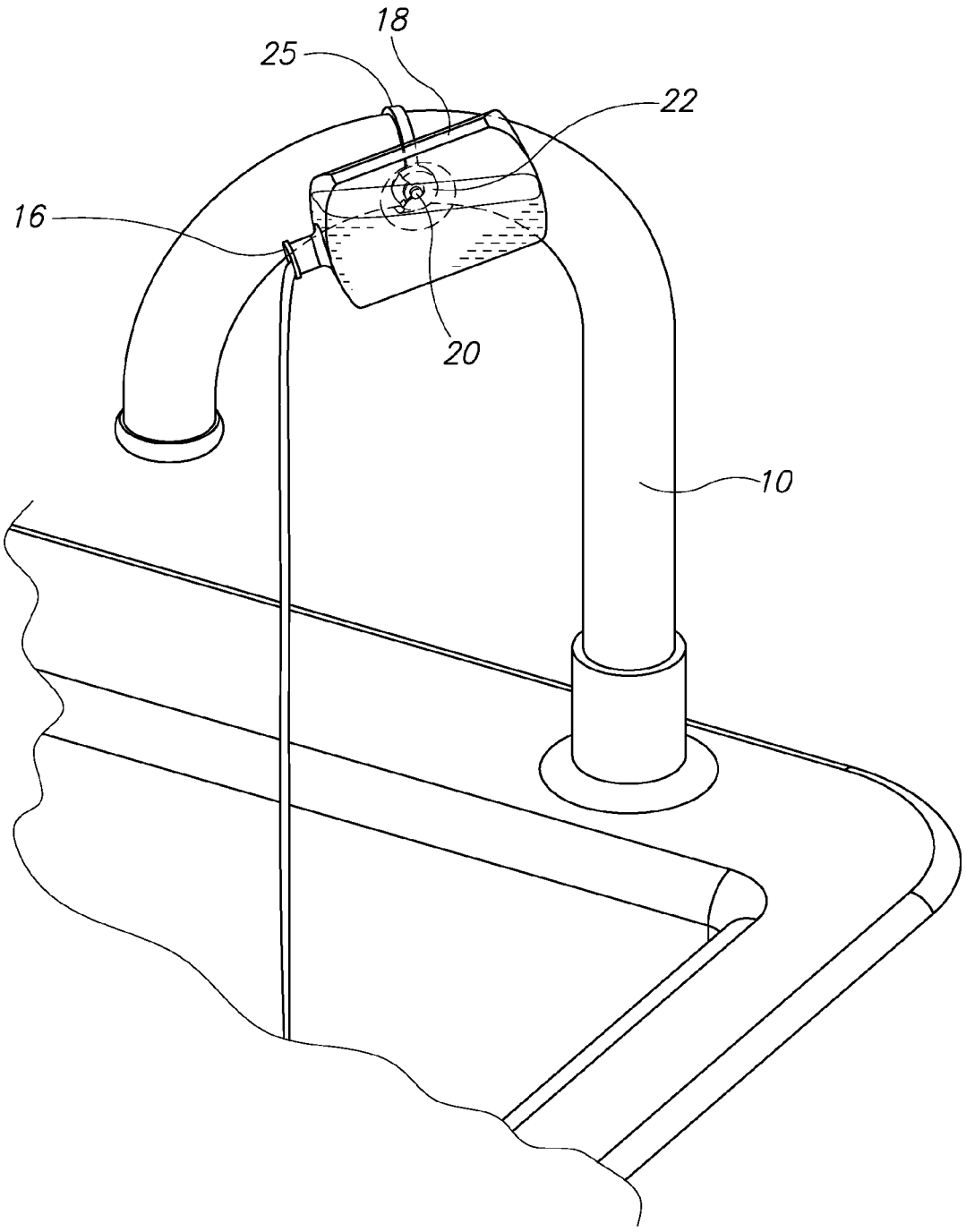
Figure 3:
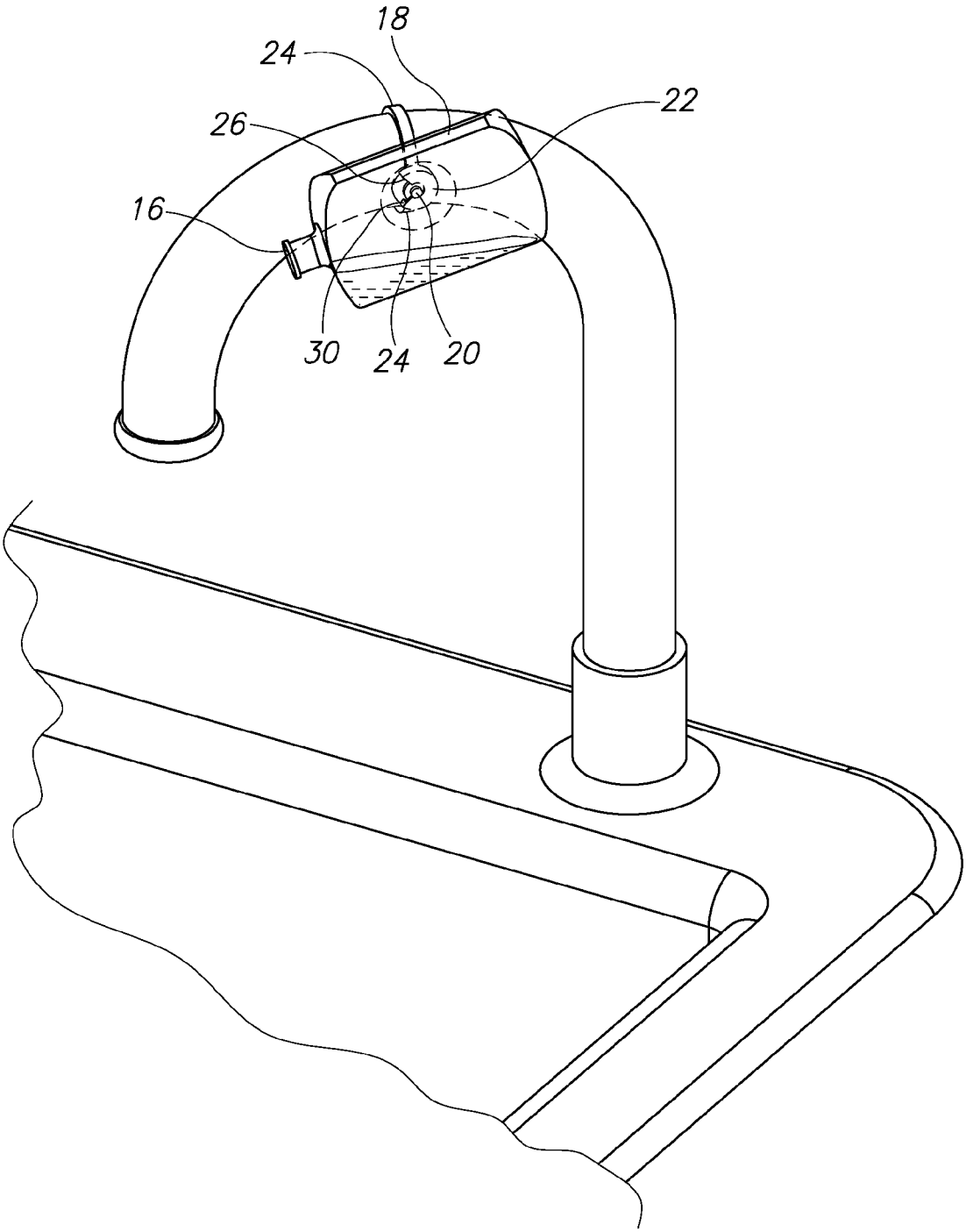

Referring to FIGS. 1, 2 and 3 in sequence, one notes that container 14 is rotated, changing the height of outlet 16 from a non-dispensing position at about ten degrees from vertical to a dispensing position at roughly 250 degrees rotation (as measured clockwise, though rotation may be counterclockwise or fully bidirectional). A non-dispensing position is one where outlet 16 is above the surface of fluid 18 and a dispensing position is one where outlet 16 is below the fluid surface. FIG. 2 shows fluid 18, with surface level now above outlet 16, beginning to drain due to the repositioning through open outlet 16 out of container 14 under the force of gravity alone or possibly assisted by manual squeezing. It should be noted that full 360 degree rotation is not necessarily required. Container configurations are contemplated which may require as little as a 60 degree to 90 degree arc of rotation to move the outlet from non-dispensing when substantially full to dispensing substantially completely. For instance, a square container having the outlet at one corner merely needs a total rotation range of 90 degrees to cover at least one of each possible dispensing/non-dispensing elevations. A triangular container can be rotated through a complete range of needed elevations in as little as 120 degrees. An elliptical container could be nearly completely drained with as little declination of outlet 16 as 40 degrees below horizontal.

Note that each dispensing operation (as well as refilling) changes the fluid level and hence the dynamics of the dispenser. For example, the center of gravity shifts ever lower, as does the point between dispensing and non-dispensing positions. In prior art pouring dispensers, the outlet position does not adjust to changes in the fluid level as the fluid level drops. Therefore, those known containers must be manipulated more and longer in subsequent dispensing operations to allow for viscous fluids to "catch up" to the changed outlet elevation.

With reference to FIG. 2, if the dispenser is left in a dispensing position, gravity causes fluid 18 to drain from container 14 as long as the fluid surface is above the edge of the opening of outlet 16 and then stops on its own once the fluid surface level is below the opening 16, as shown in FIG. 3. In actual use, this feature helps to prevent the complete loss of contents caused by, for example, a child forgetting to reposition or recap the container 14. Furthermore, since the difference between the dispensing position and non-dispensing position can be finely controlled, a user can position the container between dispensing operations such that viscous contents can accumulate directly adjacent to but slightly below the outlet, ready for immediate dispensing upon the next use. Incidentally, where a container is provided with a resealable cap, a user can choose to simply cap the container, rather than reposition it upwards, allowing fluid to accumulate right at the outlet, primed for the next use.

Referring to FIGS. 4A, 4C-4E and 5A-5D, coupler 22 is positioned with its rear gripping surface 27 against the fixture 10. At its upper ends, coupler 22 comprises strap-retaining members 28, for example, hooks, pegs or barb slits and is maintained in place by slipping one perforation 61 of elastic strap 25 over one strap-retaining member 28, stretching strap 25 tightly around fixture 10 and slipping another distal perforation 62, chosen to retain the tautness, over the other strap-retaining member 28. Container 14 is attached to fixture 10 by coupler 22 which is shown having on its front side a skeleton-keyhole shaped pivot slot 30 in the outer wall of a receiving chamber 29. Container 14 and coupler 22 are rotatably joined by a pivot button 20 comprising a flange 26-topped neck (or shaft) 19 extending axially from container's 14 rear wall 99 roughly perpendicular to outlet 16. Flange 26-topped neck 19 and face 44 are complementary in shape and dimension to pivot slot 30 and the surface of the receiving chamber 29. Tight tolerances between the interfacing surfaces of pivot button 20 and receiving chamber 29 permit flange 26 to be slid somewhat forcibly down into pivot slot 30 past retaining constriction 31 and or restraining beads 32 until seated in the closed circular bottom well 33 of pivot slot 30. In another exemplary embodiment (seen for example in FIGS. 6A-6C), flange 226 may be frusto-conical and pushed through an appropriately smaller sized hole provided in the outer wall of the receiving chamber. Finally, referring to FIGS. 27A-27B and 28A-28C, it can be seen that the length of slot 230 may be quite extensive, and that a plug 397 may be inserted to prevent pivot button 820 from sliding out towards the slot's open end when container 614, 814 is inverted. Both structure types result in a secure pivoting relationship established between the container and the coupler at one or more surface interfaces, for example between button neck 19 and the bottom round portion of pivot slot 30, among others.

In order to ensure that container 14 is manually and incrementally rotatable while installed in coupler 22, at least some portion of the interfacing surfaces between container 14 and coupler 22 are constructed to have sufficient friction between contacting surface areas to be able to withstand the torsional forces exerted by gravity on a partially filled container. The torsional forces to be counteracted depend on several factors including, for example, the position on rear wall 99 of pivot button 20 and the density of the fluid contents. Although pivot button 20 is shown centered on rear wall 99, reducing the friction required to keep container 14 from moving on its own, positioning it off-center has advantages in certain applications, depending on how the shifting center of gravity of the fluid in the container affects the frictional force required to keep coupler 22 from twisting about fixture 10. As described above, a preferred balance of friction is achieved for a container having any given size and shape when the outlet 16 of the fluid container 18 can easily be vertically displaced about the axis formed by the pivot button of the container in the coupler 22 using manual rotation by an adult or child, yet remains where positioned until acted upon again by the user, regardless of how full or empty it is. Thus, once positioned with the outlet below the surface level of the fluid contained therein, the fluid flows out out until the surface drops to just below the level of outlet opening 16 or until it is repositioned to a non-dispensing position by the user, preferably just enough to be primed and ready for use by the next user with minimal time lag.

As mentioned hereinabove, coupler 22 comprises a structure for providing the dual functions of [1] facilitating manual repositioning of outlet 16 relative to fluid 18 in a plane having a vertical component between dispensing and non-dispensing positions and [2] attaching fluid container 14 to a fixture 10 causing it to be suspended. Thus there are two attachment sites per coupler 22 and either one, or both, of the attachment sites of an exemplary embodiment of a coupler provides the rotational repositioning function. In other words, in one embodiment (see FIGS. 20A-20C), the coupler is stationery with respect to the container to which it is attached and the entire fluid dispenser is rotated around the fixture, or in a second embodiment, the coupler is stationery with respect to the fixture, as in the above-described embodiments. Finally, embodiments of the container and coupler may be movable with respect to both the fixture and one another. Regardless of the actual embodiment of container and coupler used, the container is suspended from the fixture in a desirable place and is manually displaceable in a plane having at least some vertical component.

Referring particularly to FIGS. 7A-7G, fixture attachment mechanism 523 provides the attachment required between coupler 22 and fixture 10. The illustrated exemplary embodiment of a fixture attachment mechanism 523 further comprises a fixture gripping surface 527 on the somewhat U- or V-shaped concave inner surface created between fixture engaging members 524, extending outward from the side of coupler 22 opposite slot 530. Fixture gripping surface comprises a modification of the surface provided to enhance the stability of coupler 22 on fixture 10 and may comprise surface coating, texturing, stepped profiling, dimples, ridges, grooves and could even be molded from a different, stickier material than the rest of coupler 22, such as rubber, silicone, vinyl, etc. Fixture engaging members 524 are distanced apart to provide the fixture gripping surface 527 and are shown terminating distally in strap retaining members, here shown as slot 541 and button-receiving slot 530. For examples of additional embodiments of fixture gripping surfaces, reference is made to FIGS. 4E, 15A-15F, 16 and 17 showing additional possible different profiles.

Figure 4A:
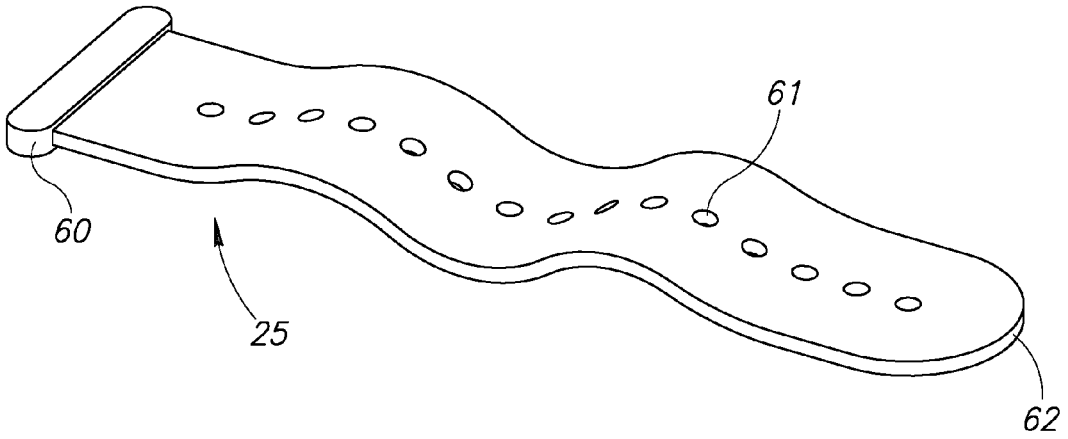
FIGS. 4A-4E are perspective views of exemplary embodiments of anchoring straps for use with exemplary embodiments of couplers such as those shown in FIGS. 5A-5D and FIGS. 7A-7G, respectively.
Figure 4B:
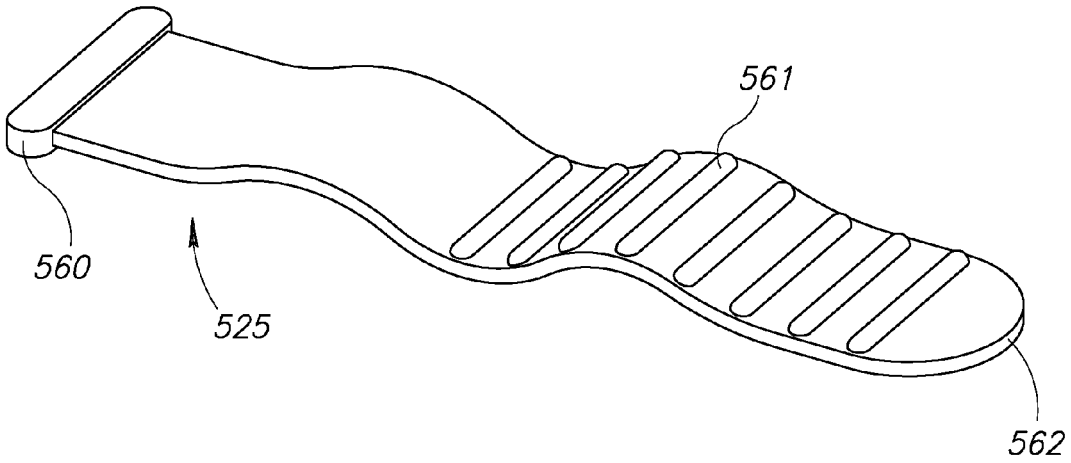
Figure 7E:
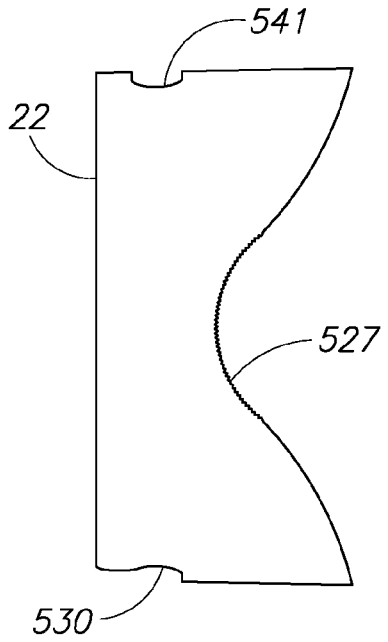
FIG. 7E is a left side inverted elevation view of the exemplary embodiment of the coupler in FIG. 7A.
Figure 7F:
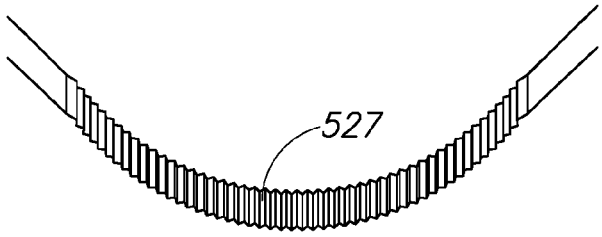
FIG. 7F is a detailed perspective view of a gripping portion of the exemplary embodiment of the coupler in FIG. 7A.
Figure 7G:
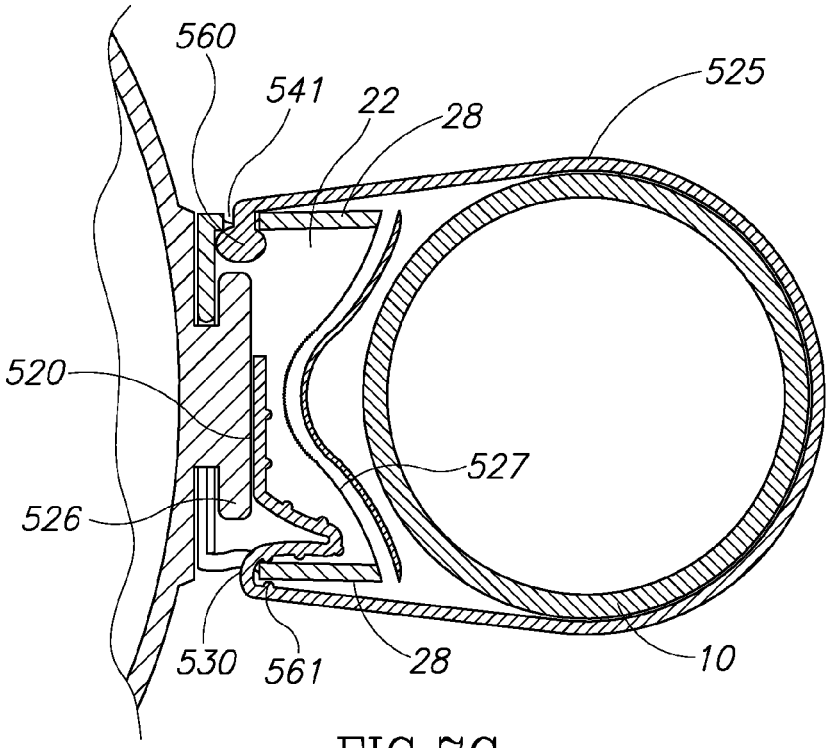
FIG. 7G is a detailed cross-section view of the exemplary embodiment of the coupler in FIG. 7A, installed against and anchored to a longitudinal fixture using the strap of FIG. 4B.

Referring to FIG. 7G, when positioned with fixture gripping surface 527 pressed against the surface of a fixture 10, one or more retainer straps or bands 25 (FIG. 4C) is hooked and stretched between strap retaining members 28, passing over fixture 10. Referring to FIG. 4B, fixture retaining strap 525 has an anchor 560 at one end sized so it will not pass through slot 541, and the elongated portion having at least one and preferably a plurality of molded protuberances 561 is threaded through slot 541, from inside of receiving chamber 529 and out and around fixture 10 and in through pivot button receiving slot 530. When pivot button 520 is inserted into receiving chamber 529, strap 525 is trapped between button flange 526 and fixture 10. Generally speaking, the environment within which the product is expected to be used will have a bearing on choosing the characteristics of the fixture retaining mechanism. Many cylindrical or other longitudinal shaft-type fixtures can be accounted for by a single retaining strap which can be trimmed to size by the installer. Additional exemplary embodiments of fixture attachment mechanisms are described infra.

The exemplary embodiment of container 14 in FIGS. 5A and 5B has pivot button 20 integrally formed. Often, a 90 degree angle relationship is provided between the axis described by pivot button neck 19 and the long axis running between outlet 16 and the bottom 21 of container 14. The angle between pivot axis and container outlet can range very widely in other exemplary embodiments. Retaining beads 32 are formed into the inner walls of the main slot 40 of receiving chamber 29 and positioned between the open top of main slot 40 and the closed bottom thereof such that when an edge of flange 26 is aligned with main slot 30 and with neck 19 traversing pivot slot 30 and neck is depressed completely into pivot slot 30, flange 26 is pushed down past retaining beads 32 to be firmly but rotatably seated in receiving chamber 29. Coupler 22 is thus shown in FIG. 5*b* cooperating with container's 14 pivot button 20 to provide an axle that rotates in a plane having a vertical component that is easily actuated, preferably incrementally, as desired. As an alternative to a relatively two-dimensional button flange 26, a ball-shaped pivot button can be seated in a complementary semi-spherical shaped joint socket-type receiving chamber formed on a coupler. Design considerations would include clearance between outlet 16 and fixture 10, as well as outlet 16 and intended target work area of the fluid being dispensed.

Figure 6A:
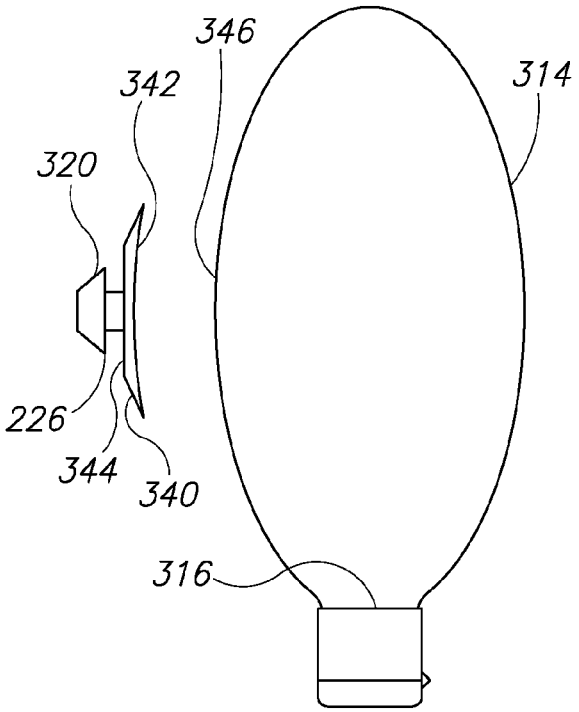
FIG. 6A is an exploded front elevation view of an exemplary embodiment of a fluid dispenser constructed in accordance with teachings of the disclosure.
Figure 6B:
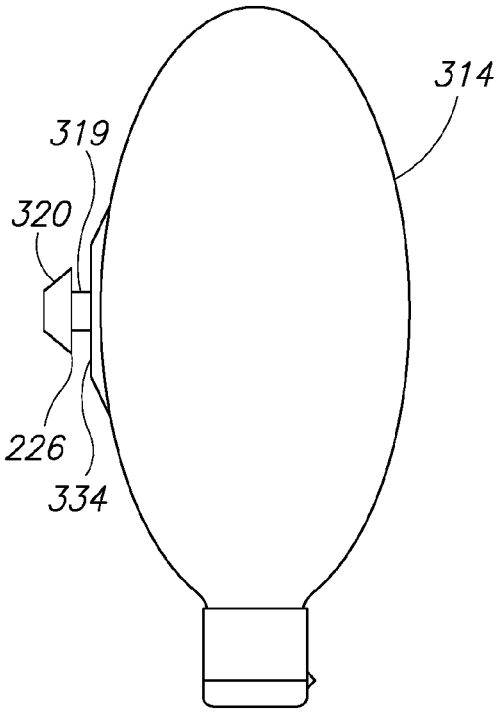
FIG. 6BA is a front elevation view of the exemplary embodiment in FIG. 6A with the fluid dispenser having a separately formed male coupler attachment member attached in accordance with teachings of the disclosure.
Figure 6C:
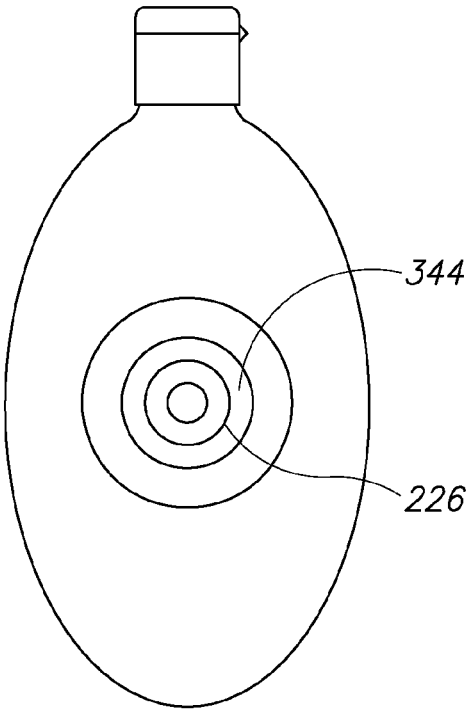
FIG. 6C is a left side elevation view of the exemplary embodiment of the fluid container with attached male coupler attachment member shown in FIGS. 6A and 6B.

Referring now to FIGS. 6A-6B, an elliptical fluid container 314 is shown having pivot button 320 as a separately formed component, attached to the outer surface 346 of fluid container 314 and extending axially outward from the outer surface 346 thereof at approximately a 90° angle with outlet 316. Outlet 316 should preferably be situated at or near container's 314 periphery, permitting it to be rotated to positions where it is near or at the highest and/or lowest points of the container as it is rotated, regardless of the overall shape. This design feature bears on how completely a container will drain when inverted and will also determine the real capacity of a filled container. Practically, the distance from the opening of the outlet to the outer edge will effect the maximum volume of fluid within the container.

As described supra, in order to promote control of the rotation and positioning of container 14, it is preferable that the surface of the receiving chamber 29 (FIG. 5B), outer surface of the coupler 22 that mates with the surface 44 of the container, slot 30 and corresponding outer surfaces of the pivot button 22 and bearing surface area 44 of container 14 immediately surrounding the base of neck 19 (collectively the container-coupler interfaces) are complementarily shaped to provide a stabilizing, friction-maintained, contact interface when pivot button 20 is completely inserted into receiving chamber 29. Interface surfaces may be further provided with textural features such as bumps, grooves, ridges, etc. or can be surfaced with friction modifying materials, such as rubber, silicone rubber and nylon.

In one embodiment, pivot button disc 320 is formed or molded separately from the container 14, 314 and affixed thereto by welding, adhesive, cohesion, or even suction alone given the right combination of materials, fluid product volume and taking into account the force needed to rotate the fluid dispenser 312 in normal use. Pivot button disc 320 comprises a base disc 340 having an inner surface 342 contoured to conform as much as possible with the intended attachment site on the outer surface 346 of container 314. Pivot button disc 320 is further provided with an interface bearing plateau 344, shown here as flat and preferably textured, on its outer surface in the area immediately surrounding the base of shaft 319. Base disc 340 is an example of one kind of reinforcement that may be applied to container wall 346 to resist flexing or distortion caused by its own weight and the twisting forces, as well as increasing the area of contact at the interface between base disc 340 and the outer surface of receiving chamber 29 when pivot button 420 is seated therein. The remainder of pivot button 320 is constructed according to the same principles described supra, i.e. with a shape intended to firmly, but rotatably engage a receiving chamber in a coupler 22.

Figure 8:
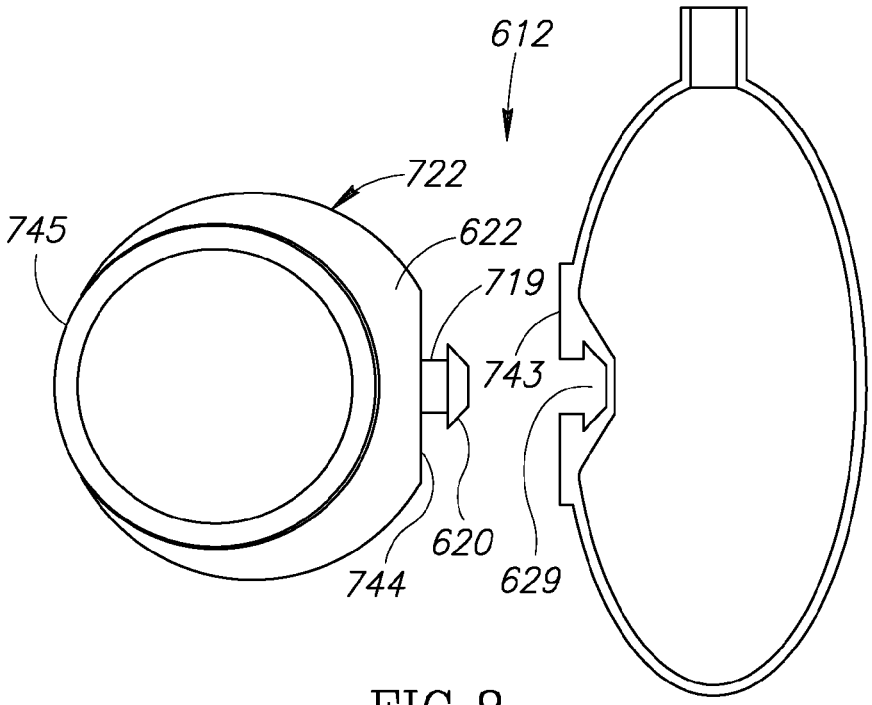
FIG. 8 is a cross-sectional view of another exemplary embodiment of a fluid container having an integrally and internally formed female coupler attachment housing and a complementary male coupler in accordance with the teachings of the disclosure.
Figure 9:
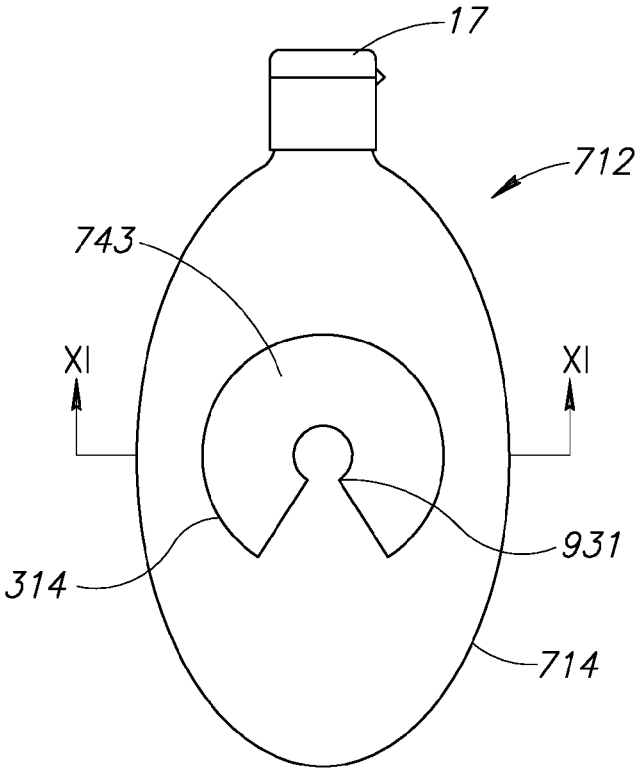
FIG. 9 is a front elevation view of another exemplary embodiment of a fluid container constructed in accordance with the teachings of the disclosure.
Figure 10:
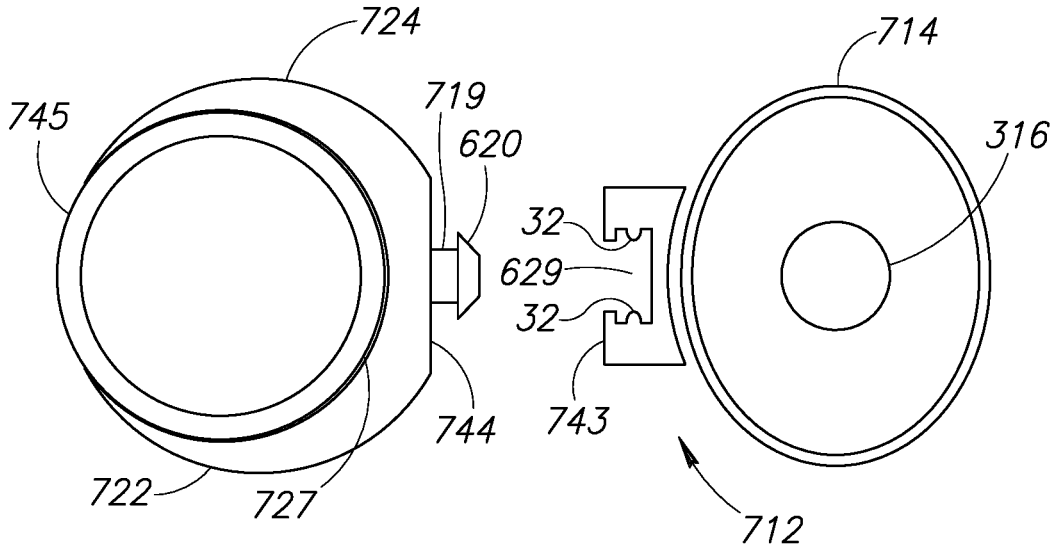
FIG. 10 is a cross-sectional exploded view of an exemplary embodiment of a fluid container as shown in FIG. 9 taken along line XI-XI and looking in the direction of the arrows, and a male coupler installed on a fixture in accordance with the teachings of the disclosure.

Referring to FIGS. 8-10, two exemplary embodiments of fluid dispensers and couplers constructed according to the principles taught by the invention are shown. FIG. 8 shows the cross section of a fluid dispenser 612 which has a female pivot receiving chamber 629 integrally formed into an exterior side surface of container 614. Fluid dispenser 612 is paired with a coupler 622 having a complementary male pivot button 620 formed on or attached thereto. Assembly requires insertion of the pivot button 620 into receiving chamber 629 until seated and rotatable.

The exemplary embodiment of fluid dispenser 712 shown in FIGS. 9 and 10 comprises a female receiving chamber 629 attached or integrally formed on the exterior surface of container 714. Coupler 722 comprises a male pivot button 620 integrally formed or attached to an outer surface thereof. The area of surface surrounding the base of neck 719 is similarly provided with an interface plateau 744, shown here as flat, that is complementary to the front face 743 of receiving chamber 629 and is preferably rubberized or otherwise textured to increase friction between the plateau and its complementary surfaces with which it interfaces. If desired, any of the embodiments described herein can be provided with texturing over any or all of the complementary interfacing surfaces to enhance friction. Coupler 722 has fixture attachment members 724 designed to engage cylindrical portions of fixtures, within a pre-defined size range determined by the flexibility and elasticity of the members 724 and the distance between the tips thereof. Coupler 722 is in the shape of a cuff describing a fixture receiver 745 in its interior. Manufacturing coupler 722 from a firm but flexible material, such as nylon, polyethylene, Delrin®, hard rubber, silicon, and the like permits sufficient spreading of its tips to permit a fixture 10 to be inserted into fixture receiver 747 as seen in FIG. 10.

Figure 11:
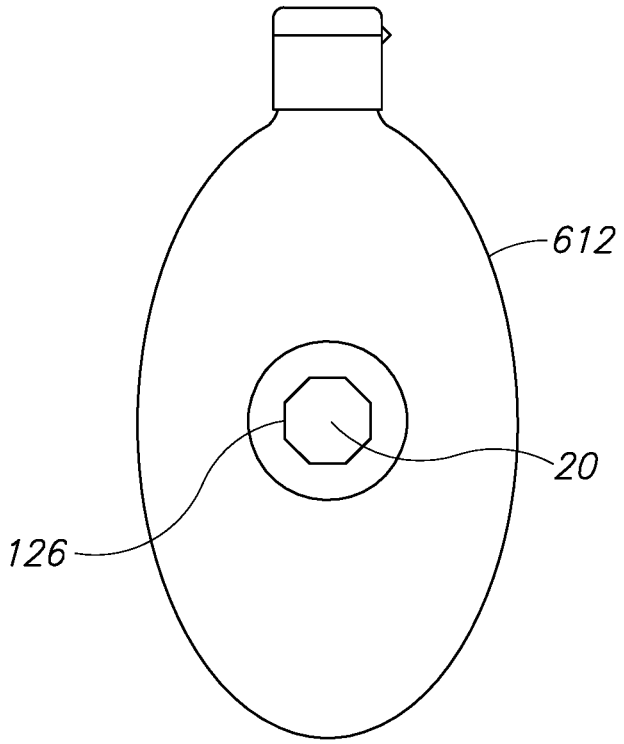
FIG. 11 is a front elevation view of an exemplary embodiment of a fluid container.
Figure 12A:
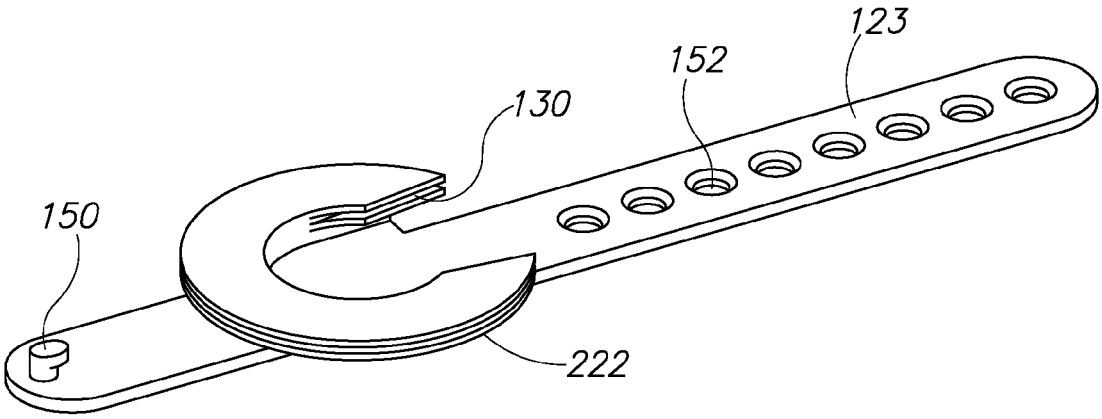
FIGS. 12A-12B are front and rear perspective views of an exemplary embodiment of a female coupler constructed in accordance with teachings of the disclosure, open and unlatched, respectively.
Figure 12B:
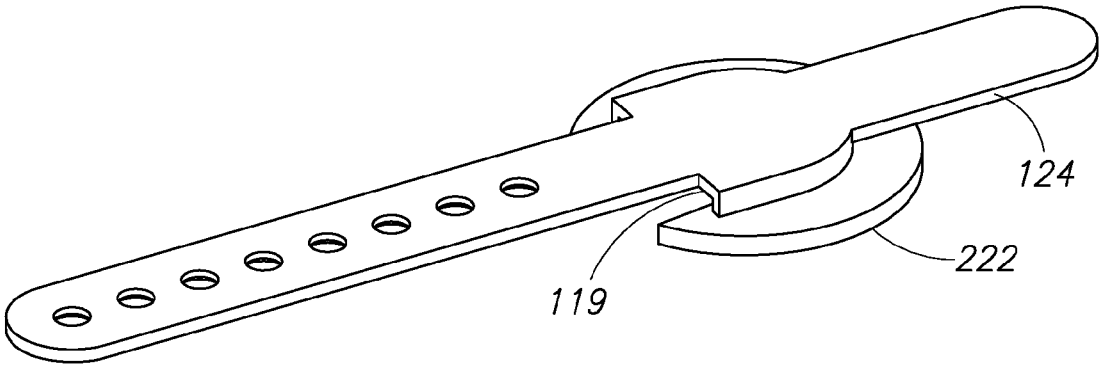
Figure 12C:
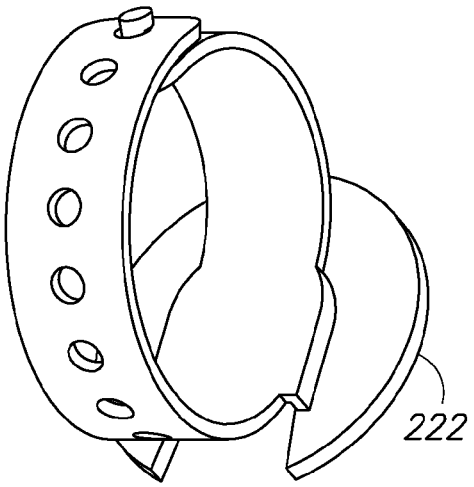
FIG. 12C is a perspective view, taken from below, of the female coupler shown in FIGS. 12A-12B, closed and latched and constructed in accordance with teachings of the disclosure.
Figure 12D:
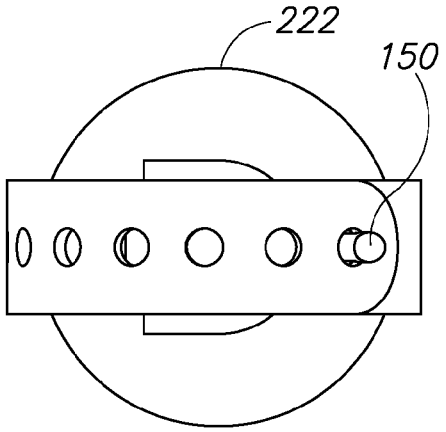
FIG. 12D is a bottom plan view of the closed female coupler shown in FIGS. 12A-12C.
Figure 12E:
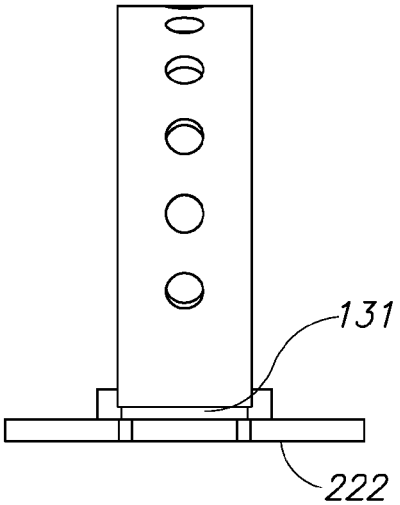
FIG. 12E is a top plan view of the female coupler shown in FIGS. 12A-12D.
Figure 12F:
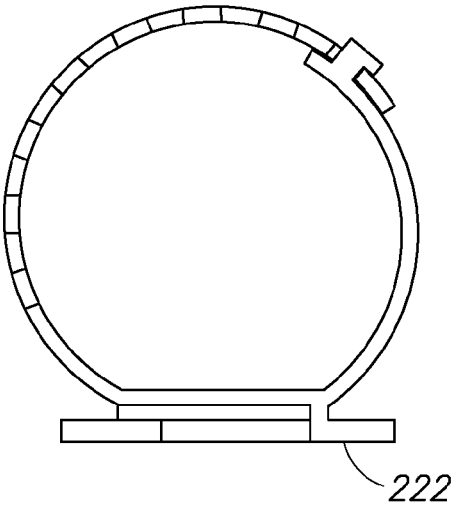
FIG. 12F is a side elevation view of the female coupler shown in FIGS. 1A-1E.
Figure 13A:
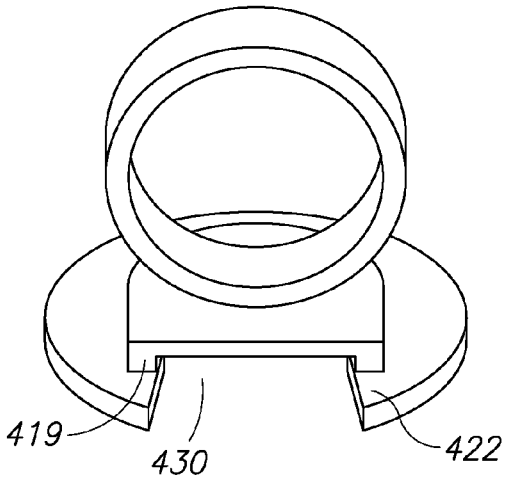
FIG. 13A is an inverted top perspective view from above and behind an exemplary embodiment of a female coupler constructed in accordance with teachings of the disclosure.
Figure 13B:
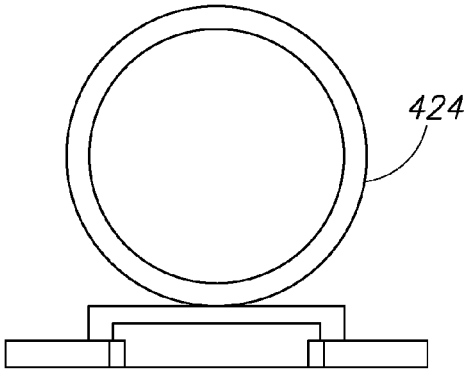
FIG. 13B is a top plan view of the female coupler shown in FIG. 13A.
Figure 13C:
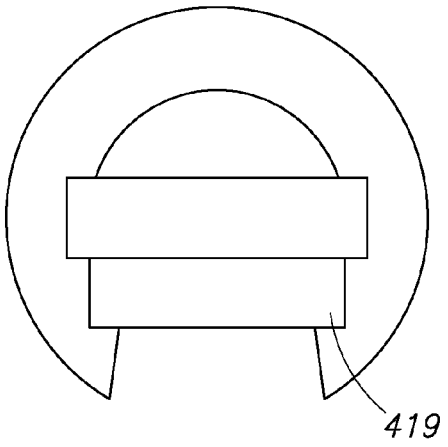
FIG. 13C is a rear elevation view of the inverted female coupler shown in FIGS. 13A and 13B.
Figure 13D:
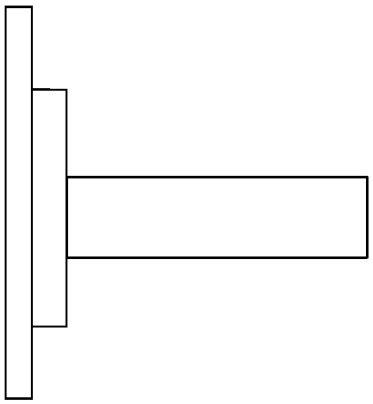
FIG. 13D is a side elevation view of the female coupler shown in FIGS. 13A-13C.

Referring to FIG. 11, flange 126 of pivot button 20 is shown having a non-circular shape, in this case an octagon. Other shapes are also contemplated as capable of providing the controlled rotation preferred by the present invention, for example, as mentioned above, a pivot button could terminate in a round or faceted ball which is received into a receiving chamber complementarily shaped like a ball socket.

FIGS. 12A-12F show a coupler 222 having fixture attaching members 123 and 124 comprising flexible straps extending from opposite sides of receiving chamber housing. Strap 123 is provided with perforations 152 and strap 124 is provided with a catch 150. Any excess strap 123 can either be trimmed or inserted into a slot 131 below and behind chamber housing 119 into the back of pivot slot 130 where it can provide additional frictional pressure to help maintain the position of a pivot flange.

FIGS. 13A-13D show coupler 422 having a relatively rigid, disc-shaped receiving chamber 419 which has a keyhole shaped pivot button receiving slot 430 and the fixture attachment mechanism being an elasticized strap 424 integrally formed so that the strap may be stretched over a longitudinal fixture's terminal end (often significantly larger in diameter than the longitudinal portion or shaft) and then released into a stable tightened position around the fixture where desired, adapting itself to the fixture's cross-sectional profile.

Figure 14A:
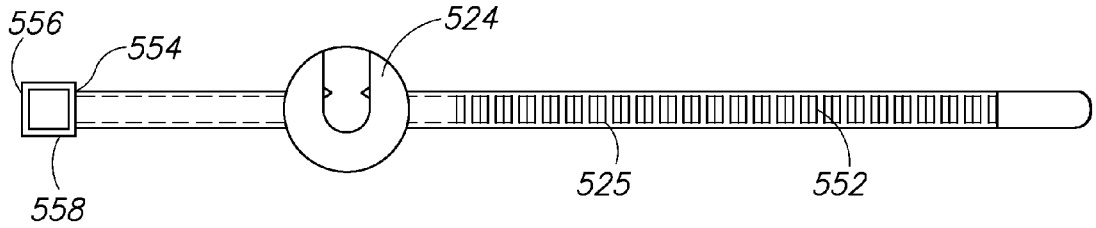
FIG. 14A is a front elevation view of one exemplary embodiment of a female coupler for attaching a fluid container to a fixture according to teachings of the disclosure.
Figure 14B:
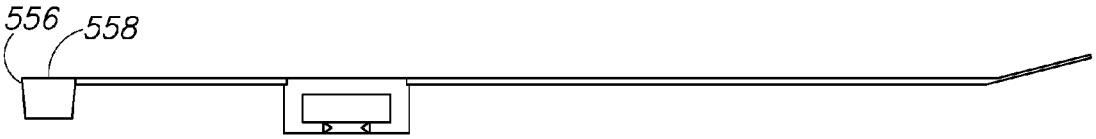
FIG. 14B is a top plan view of the coupler shown in FIG. 14A.
Figure 14C:
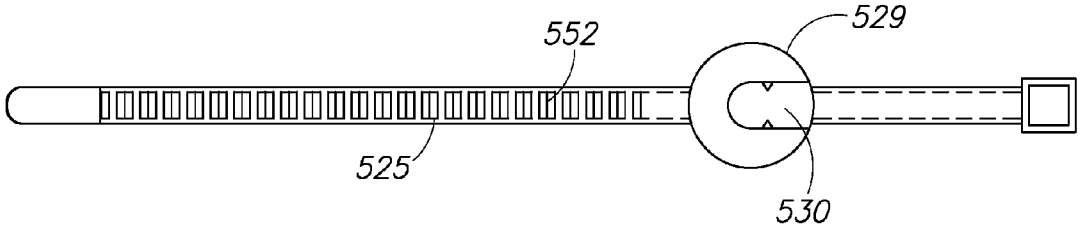
FIG. 14C is a front side elevation view of a variant of the exemplary embodiment of the female coupler shown in FIGS. 14A and 14B, constructed according to teachings of the disclosure.
Figure 15A:
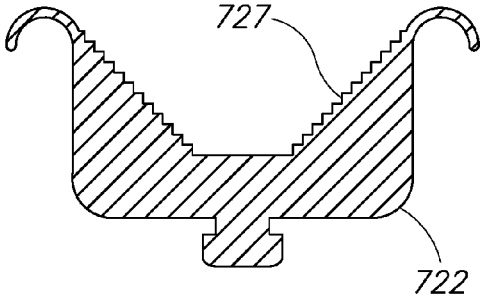
FIG. 15A is a cross-section view, of an exemplary embodiment of a male coupler, in accordance with teachings of the disclosure.
Figure 15B:
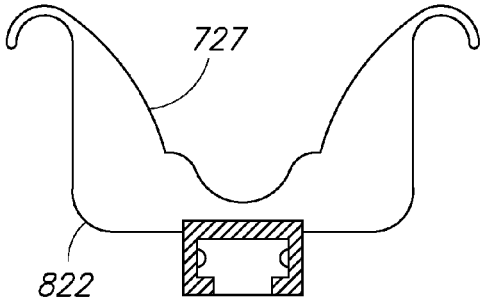
FIGS. 15B-15F are top plan views, in partial cross-section, of exemplary embodiments of couplers, in accordance with teachings of the disclosure.
Figure 15C:
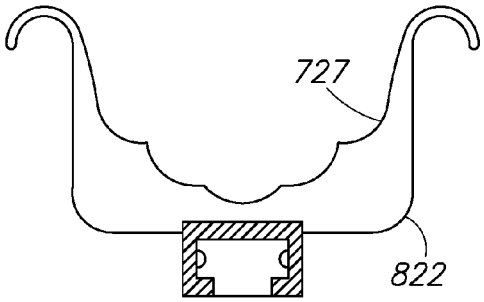
Figure 15D:
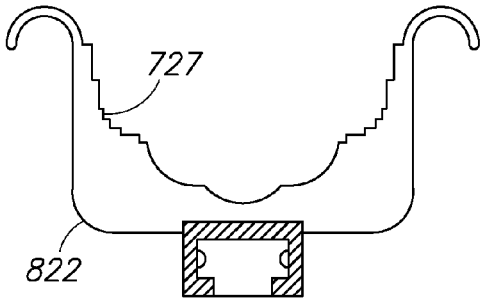
Figure 15E:
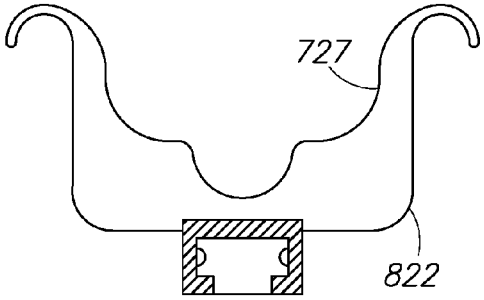
Figure 15F:
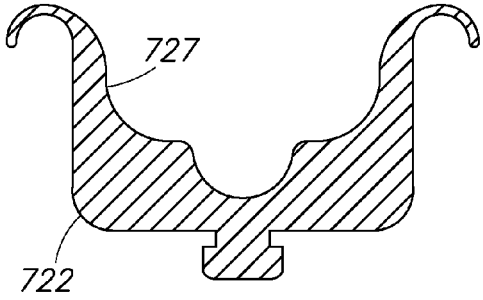

Similar to the embodiment of FIGS. 12A-12F, the couplers shown in FIGS. 14A-14C also have a disc-shaped receiving chamber 529 having a pivot slot 530 therein and having an attached (or integrally formed) retaining strap 525 extending outwardly from opposite sides of the disc. Incorporated or attached to, or extending out from, rear edge 554, a strap receiving slot 556 has an associated lock mechanism 558. Strap 525 is provided with lock engaging features 552 comprising, for example, parallel ridges across along its length. Lock engaging features 552 are shaped to interact with lock mechanism 558 when strap 525 is inserted into strap receiving slot 556 thereby locking strap 525 in position once the end thereof is wrapped around a fixture 510, inserted therein and pulled until a snug fit is achieved and maintained by the interaction of lock engaging features 552 and lock mechanism 558. Examples of similar lock mechanisms and lock engaging features are commonly known for securing cable ties, watch straps (see FIG. 4A), scuba goggle straps (see FIG. 4B) and the like, wherein the end of a notched, ridged or perforated strap is inserted through a slot and the notches ridges or perforations are engaged by a latch mechanism.

FIGS. 15A-15F show exemplary embodiments of male couplers 722 and female couplers 822 all having fixture engaging surfaces 727 shaped or otherwise enhanced to reduce unintended movement of couplers 722 and 822 when installed around a fixture (not shown) having angular cross-section features (corners and other abrupt changes). In one exemplary embodiment (FIG. 15A), fixture surface engagement enhancement is provided by texturing with ridges. Fixture engagement surfaces 727 having one of the profiles with multiple or compound curves, such as those shown in FIGS. 15B-15F, could be particularly useful. Other surface adaptations may be used to modify the characteristics of fixture engaging surfaces depending on the desired effect. For example, if the fluid dispenser design requires that the coupler remain immobile even when wet yet still be controllably rotatable around the fixture, then the fixture engaging surface may benefit from having a hydrophobic coating layer or, as seen in FIG. 7G, a piece of such material between the surface and a fixture. Providing a coupler that has regions with different properties may prove desirable, different materials can be used and either formed separately and attached to one another, or methods such as co-extrusion could be used. It is anticipated that flexible or elastic and rigid combinations of materials such as rubber, nylon, silicone, PETE, polypropylene, polyethylene, polyvinyl chloride, polycarbonate and ABS can be used, and the selection thereof is well within ability of one of ordinary skill in the art to select based on the properties desired, within the parameters of the teachings herein.

Figure 16:
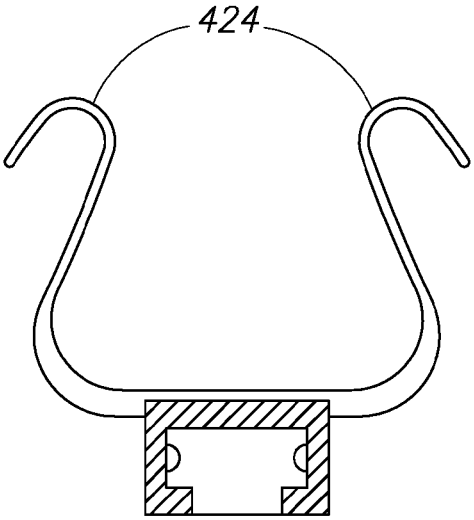
FIG. 16 is a top plan view, in partial cross-section, of an exemplary embodiment of a female coupler constructed in accordance with teachings of the disclosure.
Figure 17:
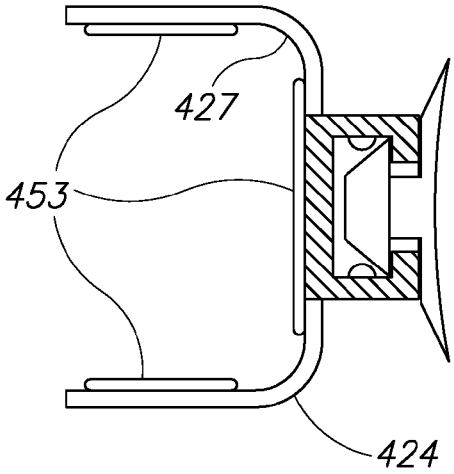
FIG. 17 is a front elevation view of an alternate construction of a female coupler in accordance with teachings of the disclosure.
Figure 18:
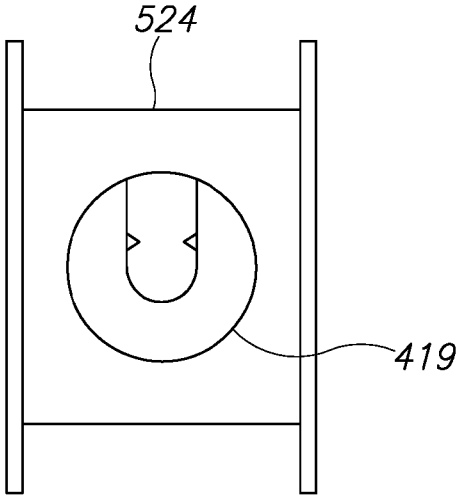
FIG. 18 is a front elevation view of a variant construction of a female coupler in accordance with teachings of the disclosure.

FIG. 16 shows a coupler having slender fixture retaining members 424 that are inclined towards one another at an acute angle to change how it grips fixtures. FIG. 17 shows a coupler having contact adhesive pads 453 on the fixture engaging surface 427 to permit positioning and installing a coupler independent of any retaining straps or bands. This exemplary embodiment may be particularly suitable for installation on fixtures such as shelf edges, counter top edges, table edges or window sills. FIG. 18 shows a coupler having fixture retaining members 524 that are wider than the receiving chamber housing 419 to better resist the torsional stress caused by rotating the fluid dispenser.

Figure 19:
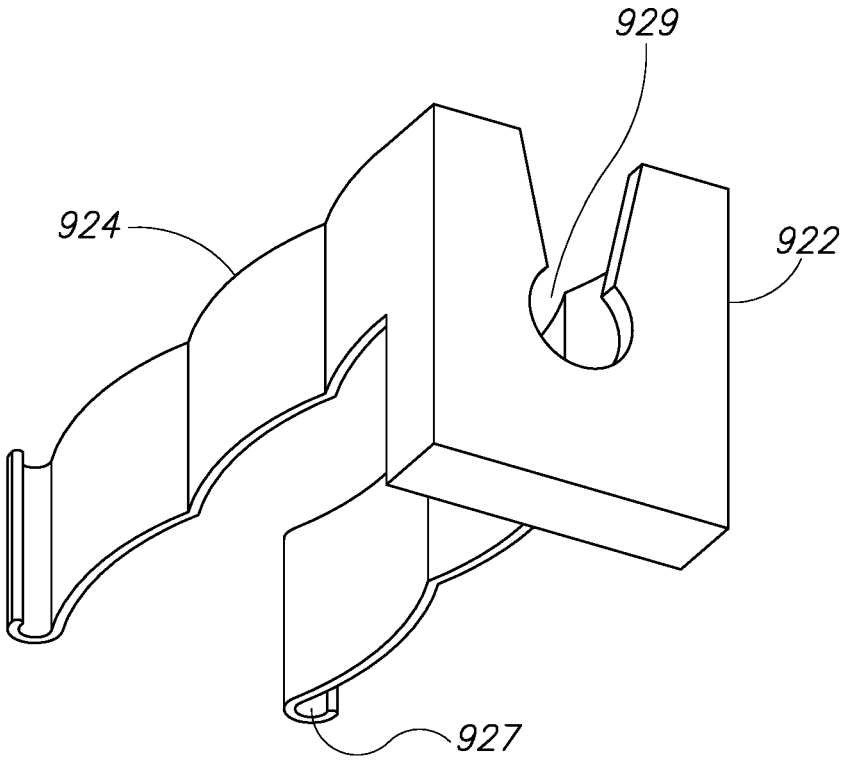
FIG. 19 is a perspective view of an exemplary embodiment of a coupler adapted for extending the fluid dispenser a desired distance from a fixture.

Referring now to FIG. 19, a coupler 922 is shown having fixture retaining members 924 which are elongated, parallel and have parallel opposing fixture gripping zones shaped, textured or otherwise adapted to grip a fixture at varying distances from the receiving chamber 929. This feature addresses situations where the fixture may be somewhat farther from the target area than in others.

Figure 20A:
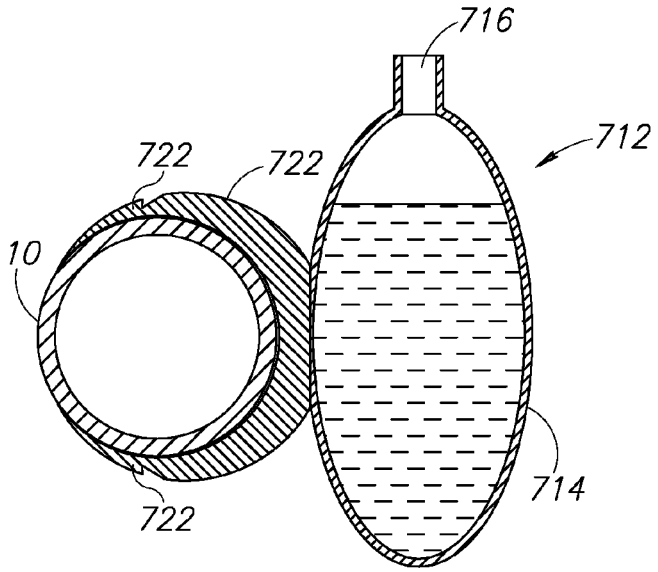
FIGS. 20A-20C are cross-sectional views of an exemplary embodiment of a partly fluid-filled dispenser and integrally formed coupler constructed and installed on a fixture, rotated to various positions, in accordance with teachings of the disclosure.
Figure 20B:
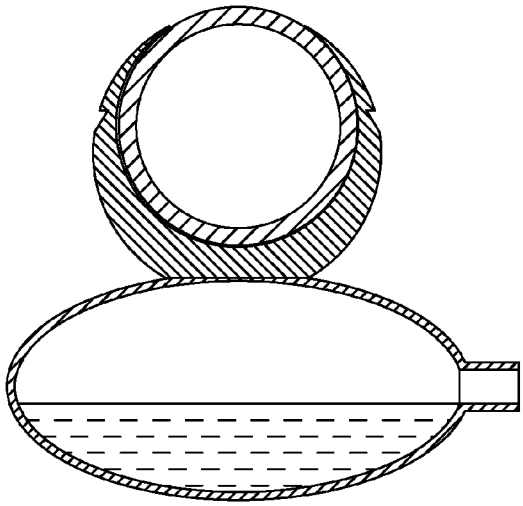
Figure 20C:
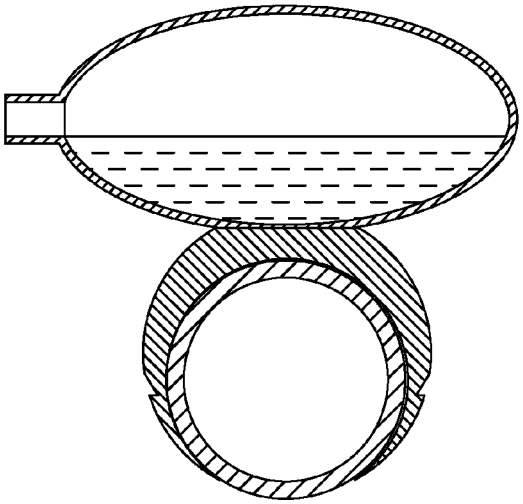
Figure 21:
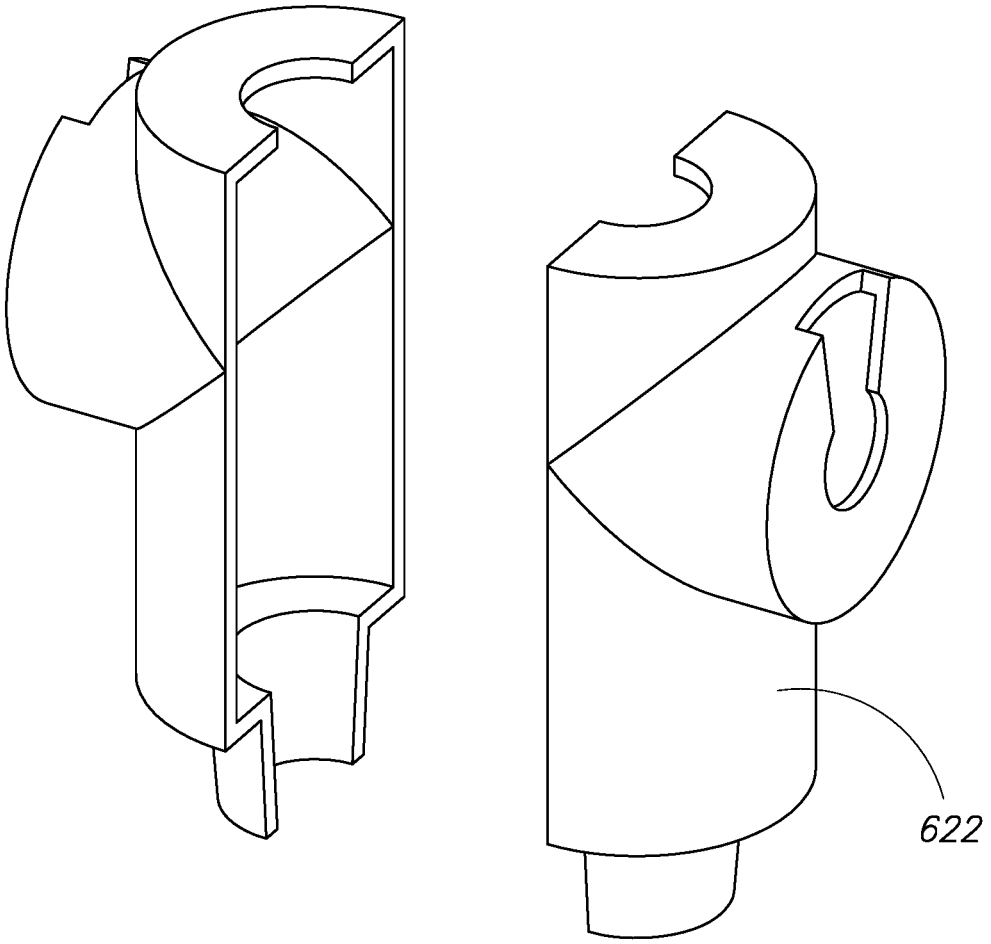
FIG. 21 is an exploded view of an exemplary embodiment of a dual container female coupler adapted for attachment to a vegetable sprayer fixture in accordance with teachings of the disclosure.

Referring to FIGS. 20A-20C, a fluid dispenser 712 comprises a container 714 having coupler 722 attached in an immobile manner on an outer surface thereof. In this case, changing the elevation of outlet 716 requires rotating the entire assembly of fluid dispenser 712 in either direction around (perpendicular to) a horizontal portion of fixture 10.

Figure 22:
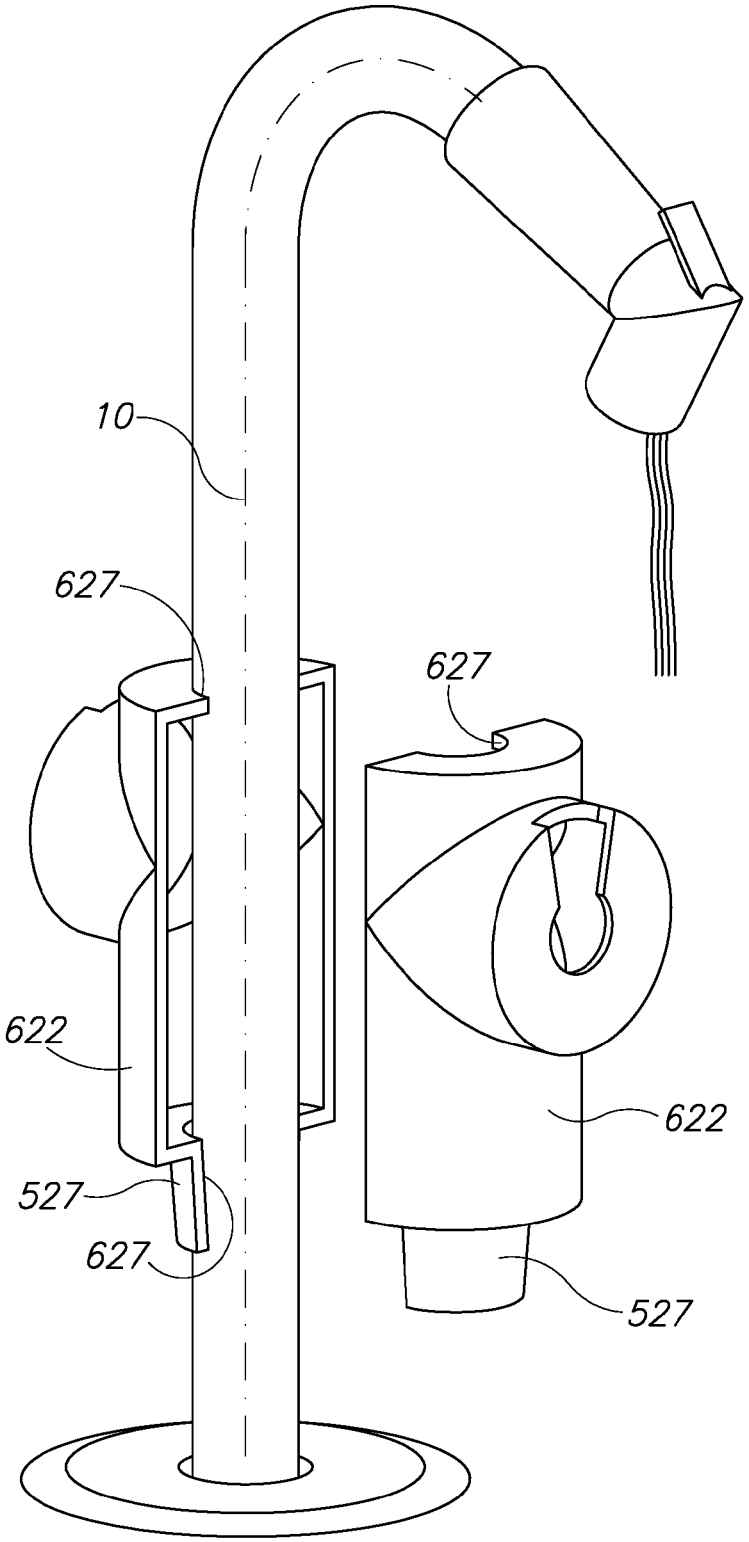
FIG. 22 is an exploded view of an exemplary female embodiment of a dual container coupler adapted for attachment to a vegetable sprayer fixture in accordance with teachings of the disclosure.
Figure 23:
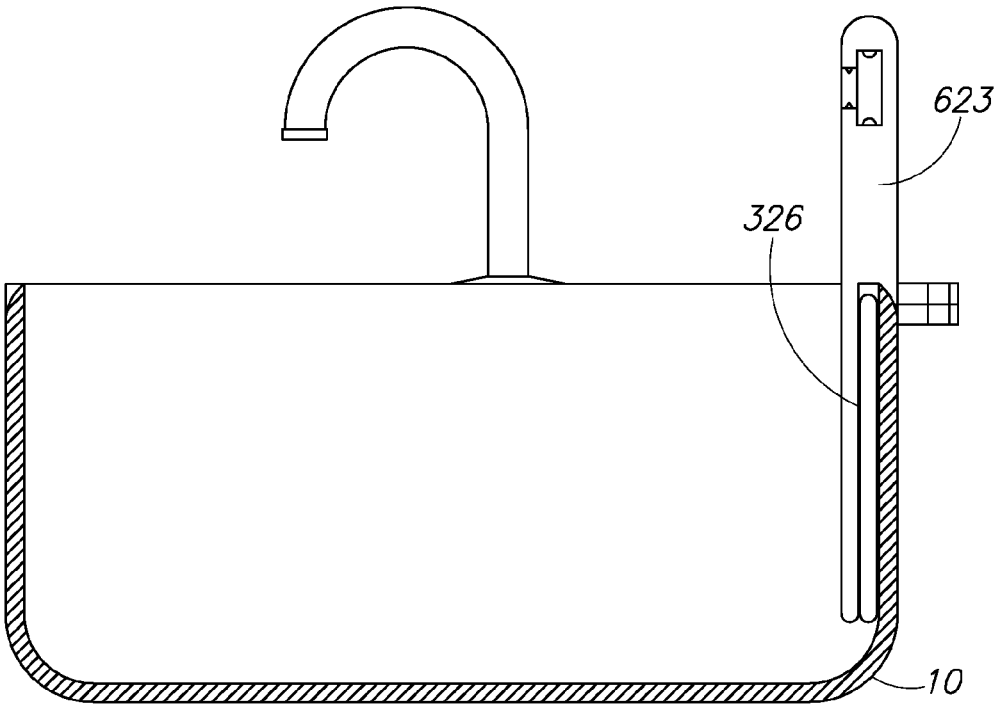
FIG. 23 is a side elevation view of an exemplary embodiment of a columnar female coupler mounted to a fixture comprising the upper rim of a sink.
Figure 24:
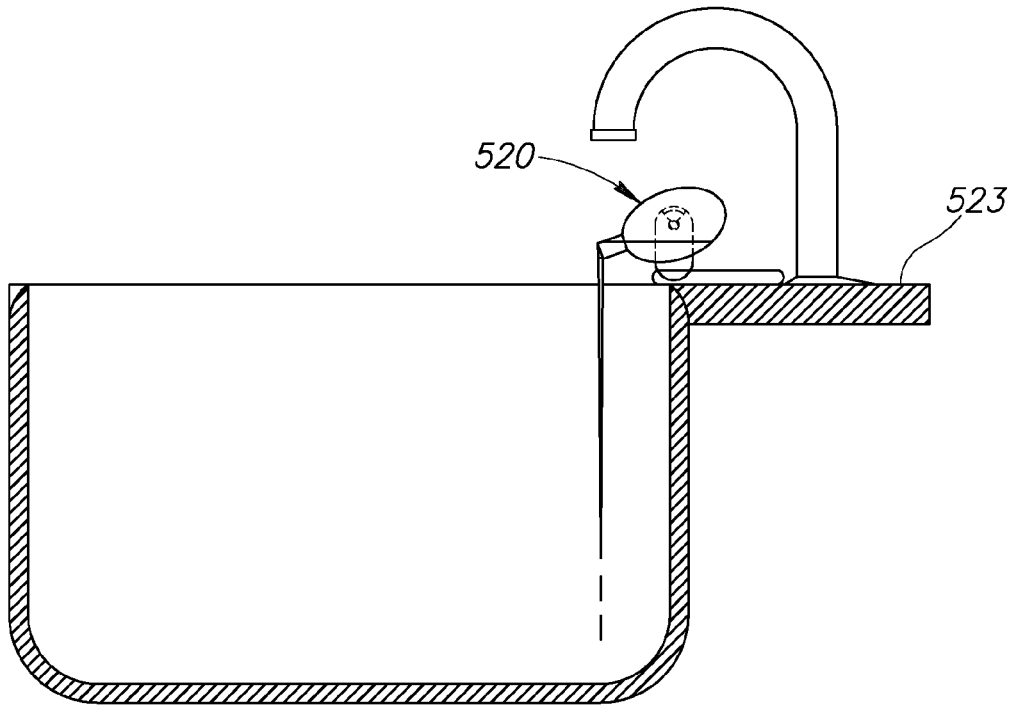
FIG. 24 is a side elevation view of an exemplary embodiment of a translucent male fluid dispensing container with female coupler mounted on a fixture comprising a countertop.
Figure 25A:
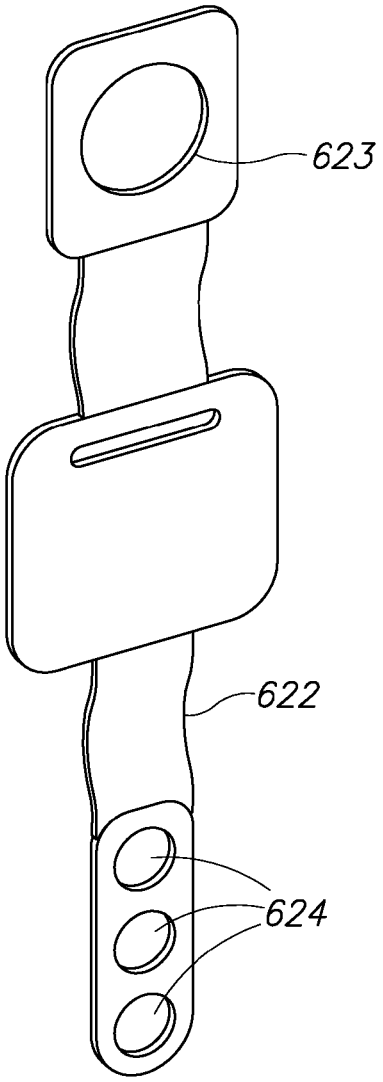
FIG. 25A is a top plan view of an exemplary embodiment of an elastic coupler constructed in accordance with teachings of the disclosure.
Figure 25B:
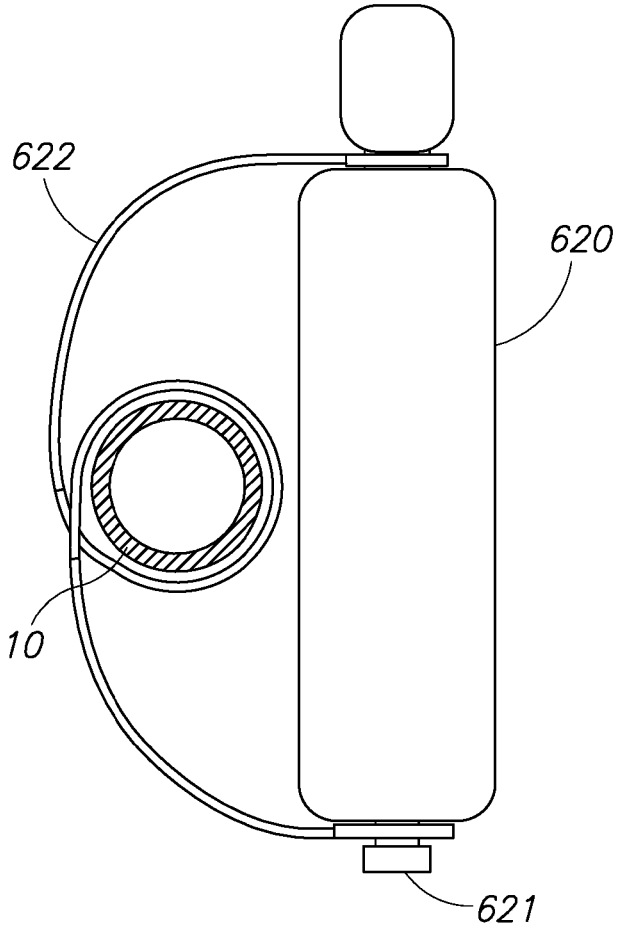
FIG. 25B is a side elevation view of the elastic coupler in FIG. 25A connected to a fluid container in accordance with teachings of the disclosure.
Figure 25C:
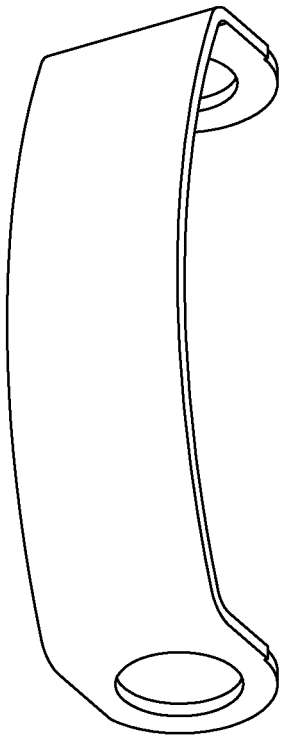
FIG. 25C is a top plan view of an exemplary embodiment of an elastic coupler constructed in accordance with teachings of the disclosure.
Figure 25D:
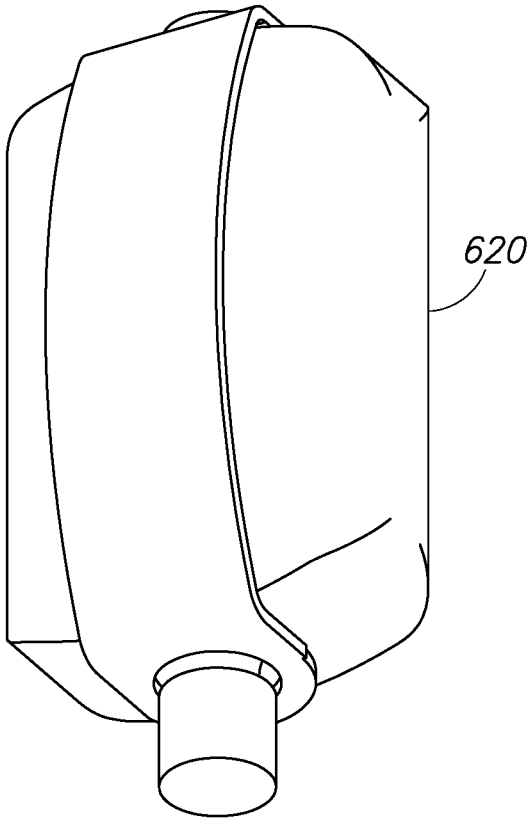
FIG. 25D is a perspective view from above and in front of the elastic coupler in FIG. 25C connected to a fluid container in accordance with teachings of the disclosure.
Figure 26A:
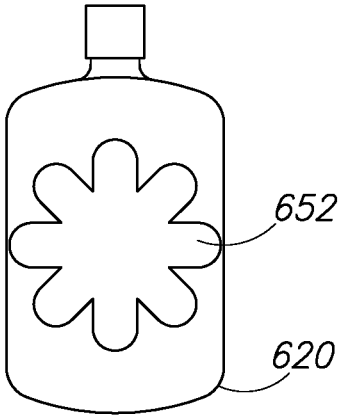
FIG. 26A is a front elevation view of a fluid dispenser constructed in accordance with teachings of the disclosure.
Figure 26B:
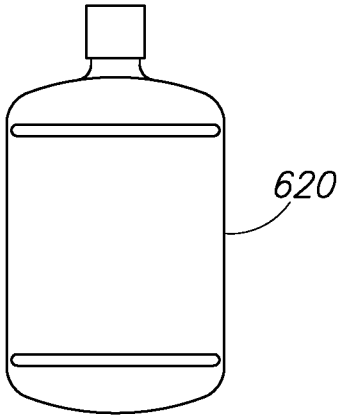
FIG. 26B is a rear elevation view of the fluid dispenser in FIG. 26A.
Figure 26C:
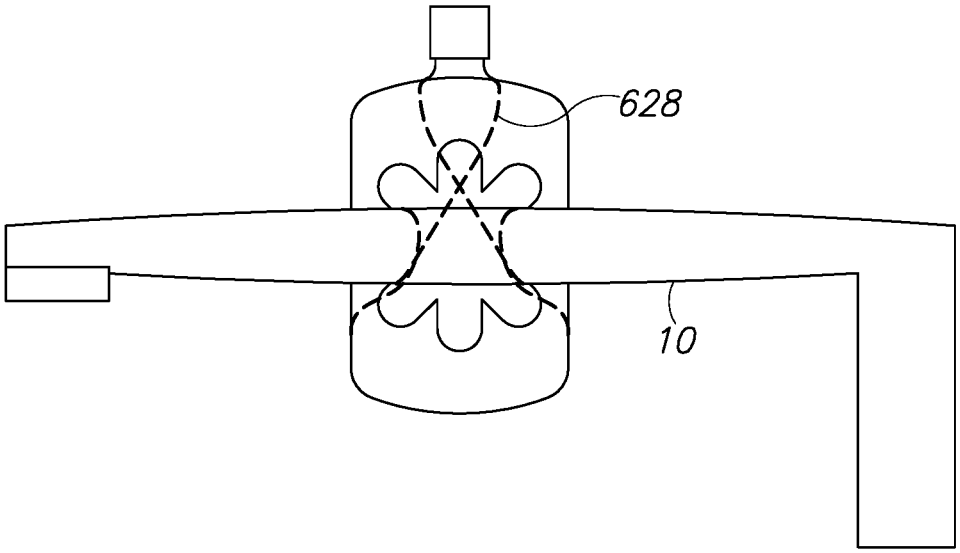
FIG. 26C is a front elevation view of the fluid dispenser of FIGS. 26A and 26B coupled to a fixture in accordance with teachings of the disclosure.
Figure 26D:
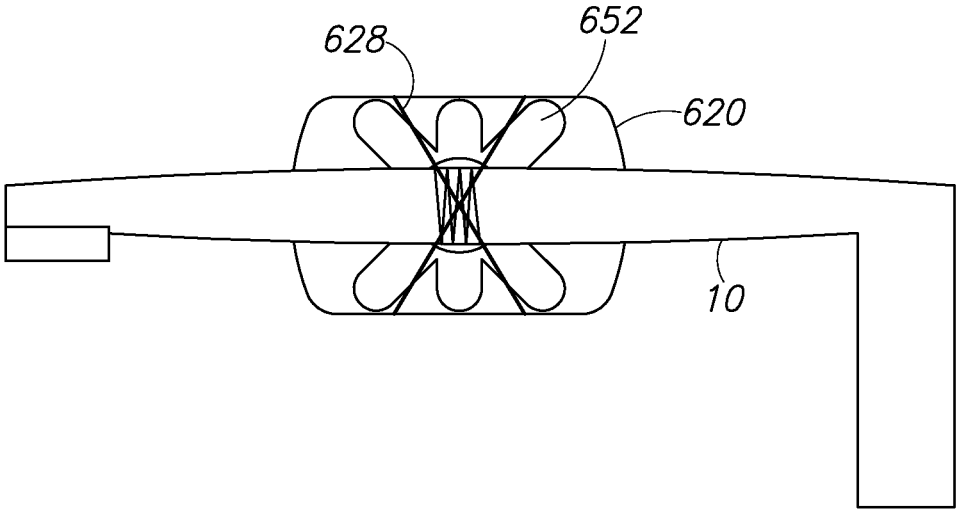
FIG. 26D is a front elevation view of the fluid dispenser of FIGS. 26A-26C coupled to a fixture in shown rotated in accordance with teachings of the disclosure.
Figure 26E:
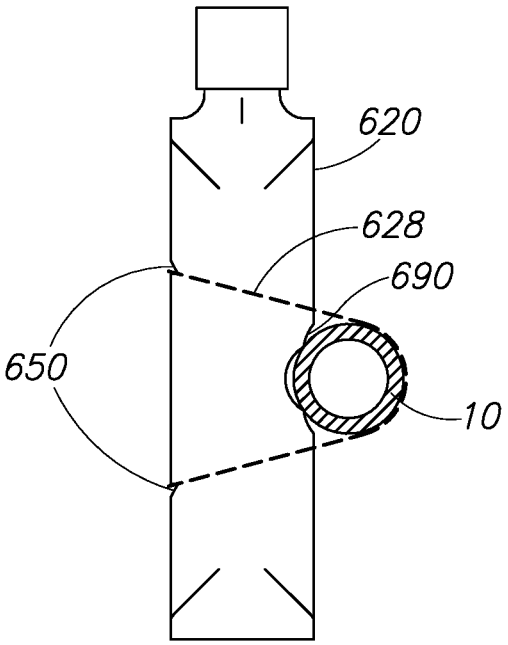
FIG. 26E is a side elevation view of the fluid dispenser in FIGS. 26A-26D coupled to a fixture in accordance with teachings of the disclosure.

A coupler may be adapted to couple more than one container to a fixture. Referring to FIGS. 21, 22, and 28A-28C, two containers each 614 and 814 are rotatably attached to coupler 822, which straddles, or encircles, fixture 10. In the case of FIG. 22, two single couplers 622, are designed to mate and interlock when brought back-to-back. Further, they are each provided with a fixture engaging surface 627 between which a spray hose passes. An outer fixture engaging surface 527 is designed to be inserted into the grommet surrounding the spray house at the level of a counter top. The coupler 622 is one example of a columnar coupler. Additional examples are illustrated in FIGS. 23 and 24A-24B. FIG. 23 shows a coupler 623 comprising a column adapted on a lower portion thereof to be attached along the upper vertical side wall of a basin. Attachment of the coupler can be accomplished by a number of methods, including for example suction cups, magnets or adhesive pads located between attachment member 326 and a surface of fixture 10. FIG. 24 shows a suspended fluid dispenser 520 attached to a horizontal work surface 523, in this instance a countertop surrounding a wash basin, and an example of a planar surface.

With reference to FIGS. 25A-25D and 26A-26E, there are shown exemplary embodiments of fluid containers adapted to be coupled to a faucet whereby as few as one or more elastic bands 622 function as the coupler and the band(s) and fixture serve as an axle for the rotation of the fluid container 620. Fluid container 620 is provided on its outer surface with a strap end button 621 and strap 622 is adapted to have at least one outlet engaging member, in this case a loop 623, and one or more end button holes 624 for receiving strap end button 621. The zone between loop 623 and end button holes 624 is elastic and stretched taut as it is wrapped about a longitudinal fixture 10, thereby rotatably coupling container 620 to the fixture. The exemplary embodiments of FIGS. 26A-26E comprise containers sculpted on one side with attachment or retention channels 650, then one or more elastic straps 628, such as rubber bands, can serve as a coupler to attach the fluid container to a faucet neck and provide elasticity to permit rotation of the fluid container in relation to the faucet. The rotation in that case might be made incremental by molding stop depressions or guide channels 652 in an outer surface of the fluid container, opposite retention sites 650, into which the faucet surface 690 could seat sufficiently to resist the memory or elastic response of the bands 628 and to prevent lateral displacement along the faucet neck. Together, the grooves and band cooperate to satisfy some of the most basic requirements of a suitable coupler.

Figure 27A:
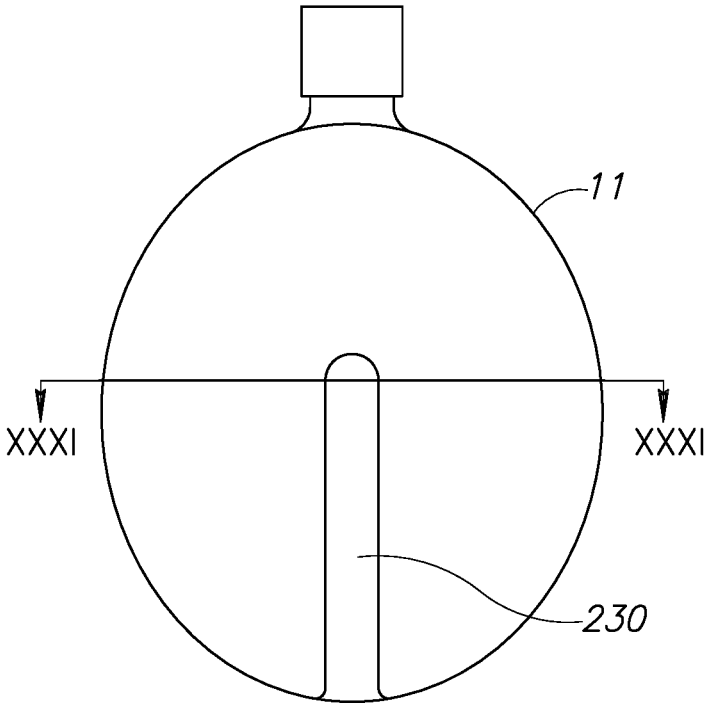
FIG. 27A is a front elevation view of a fluid dispenser constructed in accordance with teachings of the disclosure.
Figure 27B:
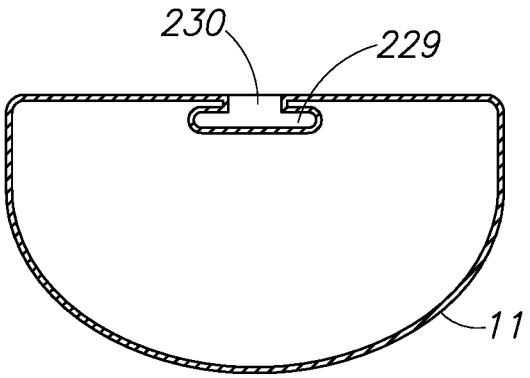
FIG. 27B is a cross-section view of the fluid dispenser in FIG. 27A taken at line XXXI-XXXI and looking in the direction of the arrows.
Figure 28A:
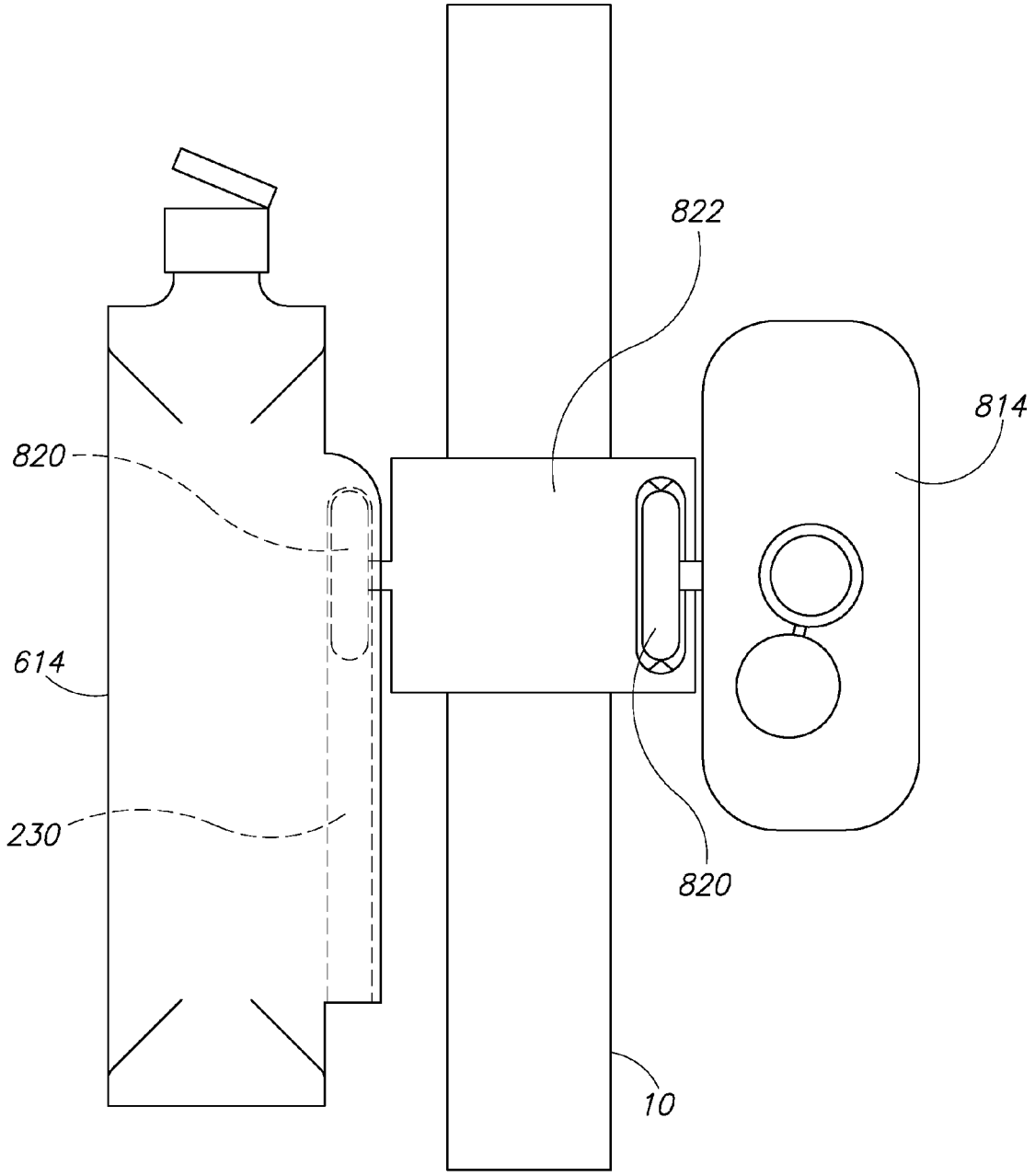
FIG. 28A is a top plan view of a pair of fluid containers coupled to a longitudinal fixture by a single coupler constructed in accordance with teachings of the disclosure.
Figure 28B:
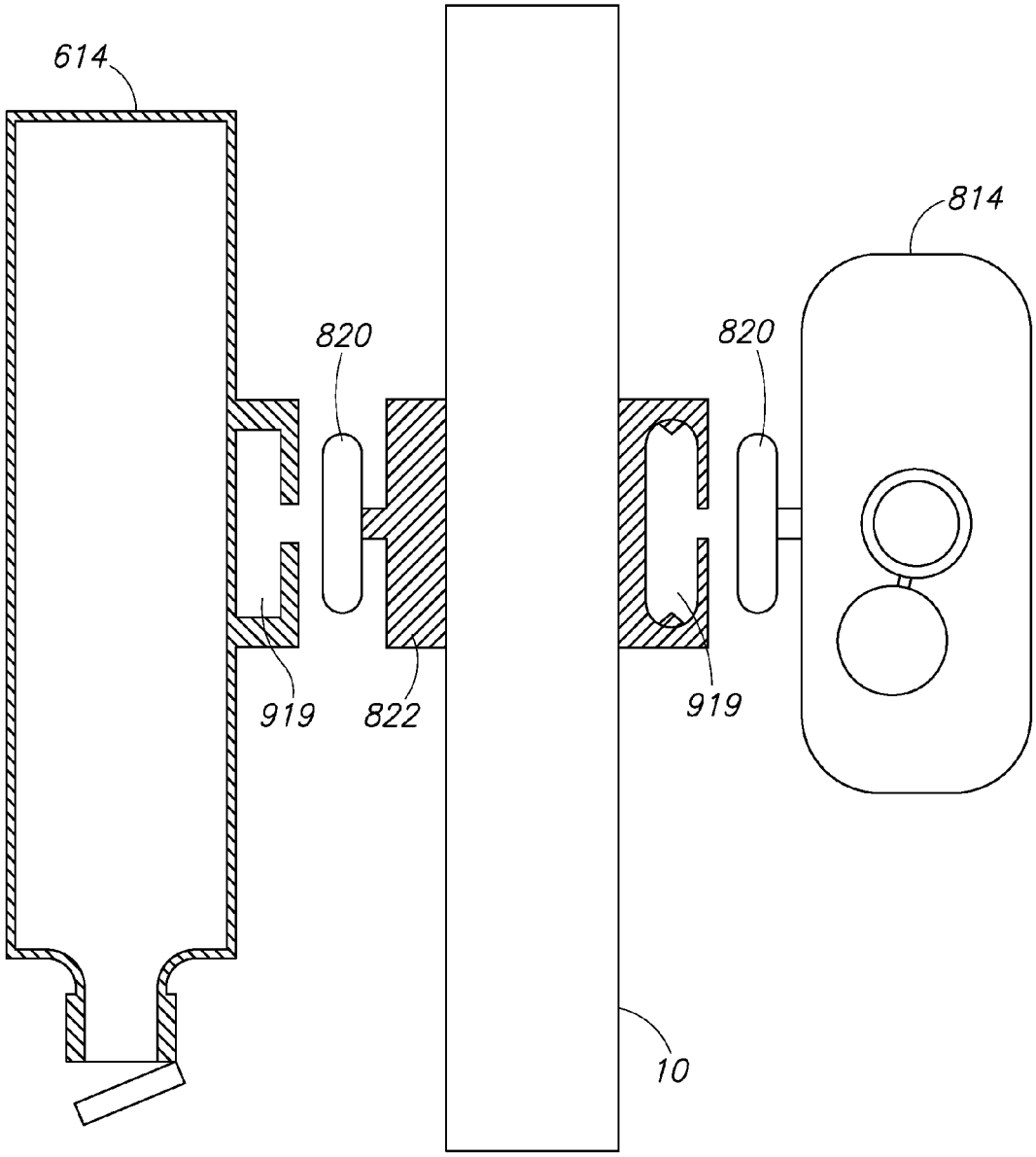
FIG. 28B is an exploded partial longitudinal cross-section view, taken from below, of the pair of containers and coupler shown in FIG. 28A.
Figure 28C:
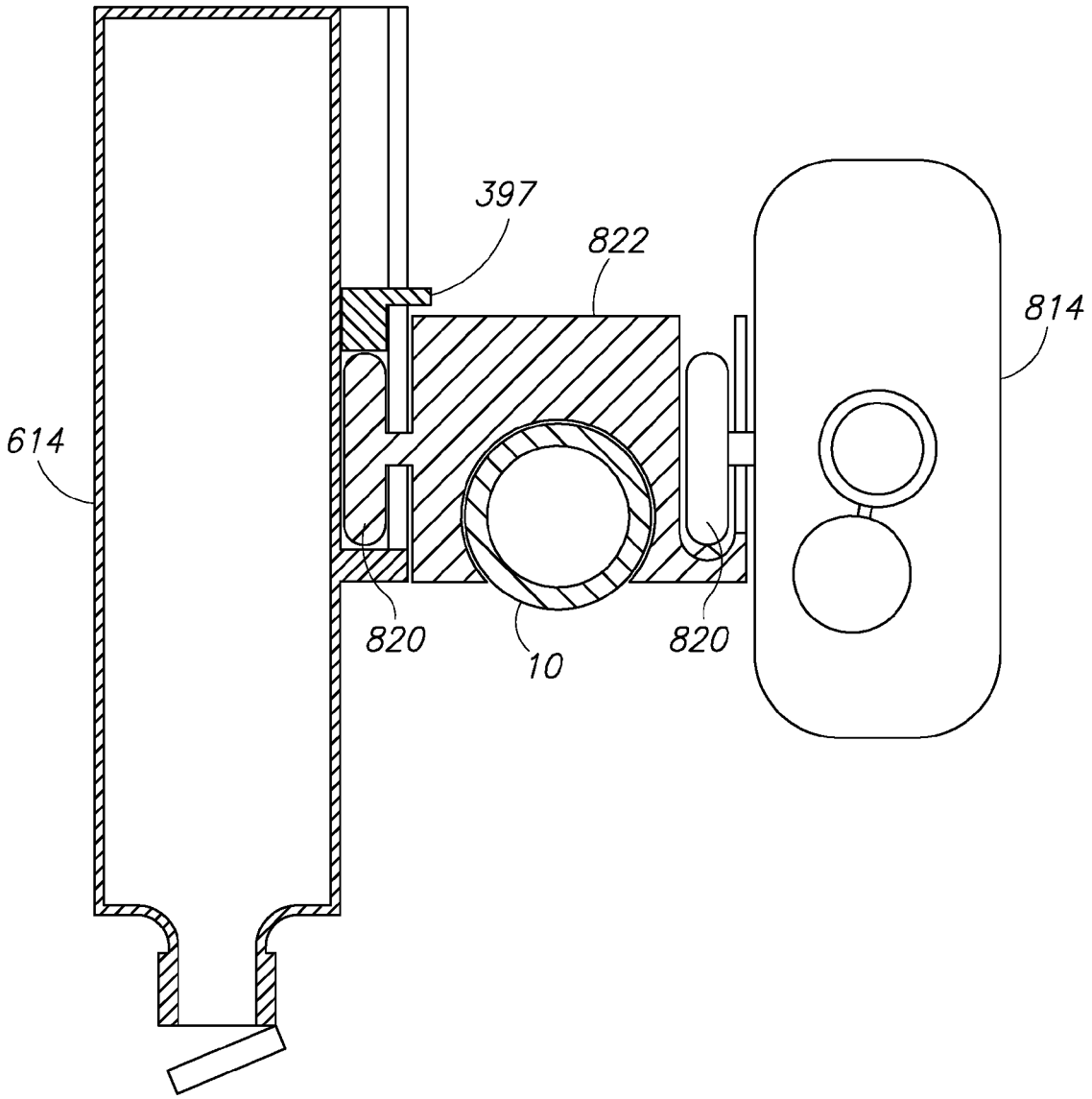
FIG. 28C is a partial sagittal cross-section taken from the front elevation of the pair of containers and coupler shown in FIGS. 28A-28B.

Referring to FIGS. 27A-27B, a container 11 is provided with a long receiving chamber having a slot which runs about half the length of the container. Referring to FIGS. 28A-28C, the containers 614, 814 are coupled to the straddling coupler previously described hereinabove. A retention plug is inserted to prevent receiving chamber 919 from slipping along pivot button. Although pivot buttons 820 are shown as engaging substantially the center of containers' 614, 814 outer surface, thus forming an axle, it is noted that eccentric arrangements of pivot buttons and complementary receiving chambers can be used for making containers 614, 814 rotatable relative to coupler 822.

A fluid container suitable for use in exemplary embodiments of the present invention can hold anywhere from less than a cubic centimeter of fluid to several liters. More commonly, the fluid container will hold between about 2 mls and 4 liters of fluid.

Figure 4C:
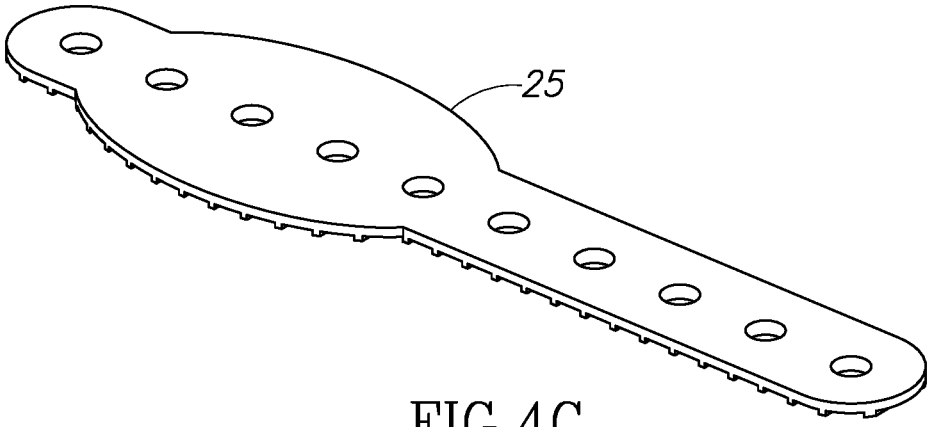
Figure 4D:
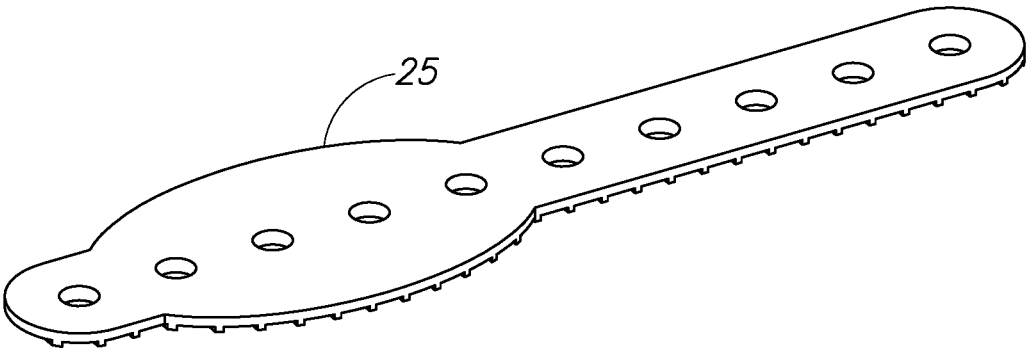
Figure 4E:
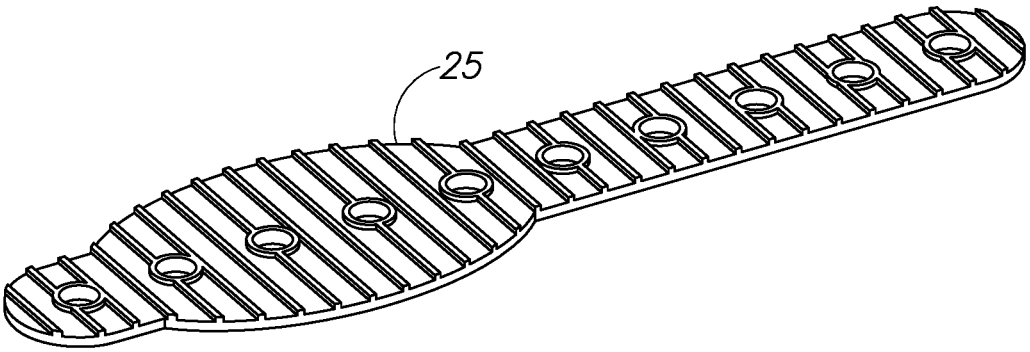

Exceptional advertising value is provided by the fluid containers of the exemplary embodiments, by improving conspicuity of the container brand, for example, spending more time in open view whether or not in use, and even adding visible surface area for advertising/marketing over the whole outside surface of the container and coupler, rather than just the container sides. For example, FIG. 4C shows a strap marked with indicia and making the strap broader serves the double purpose of increasing advertising space as well as increasing stability of the installed coupler's position.

It should be noted that exemplary embodiments of the present invention could be automated or semi-automated with the addition of appropriate circuitry including proximity and fluid level sensors, power supply, motor and controller. For example, the proximity sensor could sense when a user's hand is near the outlet, activating a motor integrated into the coupler which repositions the container, lowering the height of the outlet to below the sensed level of the fluid. After fluid has been dispensed, the motor can be reversed until the outlet is just above the sensed new surface level of the fluid and then deactivated. This arrangement results in a completely hands-free dispensing operation.

The above exemplary embodiments should be taken as non-limiting examples intended to demonstrate many of the capabilities, but not necessarily the boundaries, of what applicants consider the invention. Alterations, modifications and additions may be made to the examples and the claimed invention by one of ordinary skill in the art without departing from the spirit and scope of the invention as defined in the appended claims.

What is claimed is:

1. A fluid dispenser for attaching to a fixture, comprising:

a plastic container having at least one outlet at a first upper position in an outer surface thereof and further having an integrally formed pivot button extending axially outwardly from a centrally disposed position on said outer surface, said pivot button comprising a flange and substantially hollow neck and operative to insert into and positively engage a coupler removably attached to the fixture;

said coupler comprising a receiving chamber for receiving said pivot button, said coupler further comprising a first surface for the fixture and a second surface for contacting said container, said second surface of said coupler and said container comprising a friction-maintained interface, sufficient to withstand torsional forces exerted by the weight and flow of liquid therein, thereby forming an incrementally controllable rotational relationship between said coupler's second surface and an outside surface of said container, whereby said container rotates incrementally about the axis of said pivot button when force is applied by a consumer and is maintained at any incremental position about the axis of said pivot button when not being acted on;

said coupler comprising strap retaining members operative to removably retain an elastic strap when stretched around the fixture, thereby affixing said coupler to the fixture and suspending said container in a position suitable for use by the consumer; and whereby the consumer controls fluid dispensing from the container by re-orienting the height of the outlet between any non-dispensing position and any dispensing position, without decoupling the container from its mounting point.

2. The fluid dispenser according to claim 1, wherein the container is detachable from the coupler.

3. The fluid dispenser according to claim 1, wherein the coupler is detachable from the mounting point.

4. The fluid dispenser according to claim 1, wherein said container and said coupler are each made of one or more of plastic, rubber, hard rubber, Delrin®, nylon, silicon, PETE, polypropylene, polyethylene, polyvinyl chloride, polycarbonate and ABS.

5. The fluid dispenser according to claim 1, wherein the coupler, strap retaining members and elastic band enable the fluid dispenser to be attached to a variety of tubular fixtures.

6. The fluid dispenser according to claim 1, wherein the position stabilization comprises at least one torque resistance mechanism sufficient to resist autorotation of the container when filled or semi-filled, but not so great as to prevent manual repositioning of the container or cause unintended shifting of the coupler from the mounting point.

7. The fluid dispenser according to claim 1, wherein the container is operative to contain a fluid type consumer product.

8. The fluid dispenser according to claim 1, wherein the container is operative to contain a viscous type consumer product.

9. The fluid dispenser according to claim 1, wherein the fluid container contains a flowable consumer product selected from the group consisting of condiments, comestibles, spices, food flavorings, fluid personal hygiene products, fluid cleaning products, fluid cosmetic products, dyes, glues, paint and medicines.

10. The fluid dispenser according to claim 1, wherein the mounting point is selected from the group consisting of a plumbing fixture, faucet, pipe, a work surface, a wall, a tension rod, a tension column, a bar, a window ledge, a cabinet, a cabinet door, a shelf and a shelf edge.

11. A fluid dispenser for attaching to a fixture, comprising:

a container having at least one outlet and a male pivot button, said male pivot button and said container formed integrally as a single entity, said male pivot button comprising a flange and substantially hollow neck extending axially outwardly from said container;

a coupler comprising:

strap retaining members operative to retain an elastic strap when stretched around the fixture, thereby affixing said coupler to the fixture and suspending said container in a position for use by a consumer;

a female receiving chamber for receiving and positively engaging said male pivot button of said container;

a first surface operative to aid in holding said coupler in place in relation to the fixture when said elastic strap is stretched around the fixture and attached to said strap retaining members;

a second surface operative to engage a corresponding third surface located on said container such that when said male pivot button is fully seated in said female receiving chamber, sufficient friction is generated between said second surface and said third surface to withstand torsional forces exerted by the weight and flow of fluid in said container thereby forming a controllable rotational relationship between said coupler and said container, whereby a consumer is able to rotate said container about an axis of the male pivot button to any desired position and have said container maintain its position until said container is moved again by said consumer;

wherein said coupler is detachable from the fixture; and wherein said male pivot button is removable from said female receiving chamber.

12. The fluid dispenser according to claim 11, wherein said container and said coupler are each constructed of one or more of the following materials: plastic, rubber, hard rubber, Delrin®, nylon, silicon, PETE, polypropylene, polyethylene, polyvinyl chloride, polycarbonate and ABS.

13. The fluid dispenser according to claim 11, wherein the coupler, strap retaining members and elastic strap enable the fluid dispenser to be attached to a variety of fixtures.

14. The fluid dispenser according to claim 11, wherein when said male pivot button is engaged in said female receiving chamber sufficient friction is generated to resist autorotation of said container when full or partially full of fluid, but not enough to prevent manual repositioning by the consumer of said container.

15. The fluid dispenser according to claim 11, wherein said container is operative to hold a flowable consumer product selected from the group consisting of condiments, comestibles, spices, food flavorings, fluid personal hygiene products, fluid cleaning products, fluid cosmetic products, dyes, glues, paint and medicines.

16. The fluid dispenser according to claim 11, wherein the fixture is selected from the group consisting of a plumbing fixture, faucet, pipe, rod, bar, tension rod, tube, tubular fixture, column and tension column.

17. The fluid dispenser according to claim 11, wherein said first surface is formed or fabricated to enhance the stability of said coupler on the fixture and comprises at least one of a surface coating, texturing, stepped profiling, dimples, ridges and grooves.

18. The fluid dispenser according to claim 17, wherein said first surface is fabricated from a tackier material than the remainder of said coupler, said tackier material selected from the group consisting of as rubber, silicone, plastic and vinyl.

19. The fluid dispenser according to claim 11, wherein said second surface and said third surface are complementarily shaped to provide a stabilizing, friction maintained contact interface when said male pivot button is fully inserted into said female receiving chamber.

20. The fluid dispenser according to claim 11, wherein said second surface comprises one or more textural features selected from the group consisting of surface coating, texturing, stepped profiling, dimples, ridges and grooves.

21. The fluid dispenser according to claim 11, wherein said third surface comprises one or more textural features selected from the group consisting of surface coating, texturing, stepped profiling, dimples, ridges and grooves.

22. The fluid dispenser according to claim 11, wherein said second surface comprises a friction modifying material selected from the group consisting of rubber, plastic, silicone rubber and nylon.

23. The fluid dispenser according to claim 11, wherein said third surface comprises a friction modifying material selected from the group consisting of rubber, plastic, silicone rubber and nylon.

24. The fluid dispenser according to claim 11, wherein said strap retaining members are selected from the group consisting of hooks, pegs and barb slits.

25. The fluid dispenser according to claim 11, wherein said elastic strap comprises perforations operative to be placed onto said strap retaining members.

26. The fluid dispenser according to claim 11, wherein said elastic strap is selected from the group consisting of a silicon band, an elastic band and a rubber band.

27. The fluid dispenser according to claim 11, further comprising one or more visible surface areas on said container for advertising and marketing purposes.

28. A fluid dispenser for mounting to a fixture, comprising:

a container operative to hold a fluid, said container having at least one outlet and a male pivot, said male pivot and said container formed as a single integral entity, said male pivot comprising a flange and substantially hollow neck extending axially outwardly from an outer surface of said container;

a coupler comprising a female receiving chamber for receiving said male pivot, wherein when said male pivot is fully seated in said female receiving chamber said container is free to rotate about said male pivot;

said coupler comprising a strap retaining mechanism for holding an elastic band in place when the elastic band is stretched around the fixture, wherein a combination of said strap retaining mechanism and the elastic band function to removably affix said coupler to the fixture whereby said coupler remains suspended and fixed in position while allowing a user to rotate said container about said male pivot; and friction means incorporated in at least one of said container and said coupler, said friction means operative to allow the user to rotate said container about an axis of said male pivot while maintaining said container in a position desired by the user when the user is not rotating said container about said male pivot.

29. The fluid dispenser according to claim 28, wherein said container and said coupler are each constructed of one or more of the following materials: plastic, rubber, hard rubber, Delrin®, nylon, silicon, PETE, polypropylene, polyethylene, polyvinyl chloride, polycarbonate and ABS.

30. The fluid dispenser according to claim 28, wherein the coupler, strap retaining mechanism and elastic band enable the container to be attached to a variety of fixtures.

31. The fluid dispenser according to claim 28, wherein when said male pivot is engaged in said female receiving chamber sufficient friction is generated to resist autorotation of said container when full or partially full of fluid, but not enough to prevent manual repositioning by the user.

32. The fluid dispenser according to claim 28, wherein said container is operative to hold a flowable consumer product selected from the group consisting of condiments, comestibles, spices, food flavorings, fluid personal hygiene products, fluid cleaning products, fluid cosmetic products, dyes, glues, paint and medicines.

33. The fluid dispenser according to claim 28, wherein the fixture is selected from the group consisting of a plumbing fixture, faucet, pipe, rod, bar, tension rod, tube, tubular fixture, column and tension column.

34. The fluid dispenser according to claim 28, wherein a portion of said coupler for contacting the fixture is formed or fabricated to enhance the stability of said coupler on the fixture and comprises at least one of a surface coating, texturing, stepped profiling, dimples, ridges and grooves.

35. The fluid dispenser according to claim 34, wherein said portion is fabricated from a tackier material than the remainder of said coupler, said tackier material selected from the group consisting of as rubber, silicone, plastic and vinyl.

36. The fluid dispenser according to claim 28, wherein said friction mechanism is operative to provide a stabilizing, friction maintained contact interface when said male pivot is fully inserted into said female receiving chamber.

37. The fluid dispenser according to claim 28, wherein said friction mechanism comprises one or more textural features selected from the group consisting of surface coating, texturing, stepped profiling, dimples, ridges and grooves.

38. The fluid dispenser according to claim 28, wherein said friction mechanism comprises a friction modifying material selected from the group consisting of rubber, plastic, silicone rubber and nylon.

39. The fluid dispenser according to claim 28, wherein said strap retaining mechanism is selected from the group consisting of hooks, pegs and barb slits.

40. The fluid dispenser according to claim 28, wherein said elastic band is selected from the group consisting of a silicon band, an elastic band and rubber band.

41. The fluid dispenser according to claim 28, further comprising one or more visible surface areas on said container for advertising and marketing purposes.

* * * * *